US010370145B2

(12) United States Patent
Baltz et al.

(10) Patent No.: US 10,370,145 B2
(45) Date of Patent: Aug. 6, 2019

(54) COLLAPSIBLE CONTAINER WITH DOOR

(71) Applicant: Rehrig Pacific Company, Los Angeles, CA (US)

(72) Inventors: Kyle L. Baltz, Rossmoor, CA (US); Ryan C. Meers, West Chester, PA (US)

(73) Assignee: Rehrig Pacific Company, Los Angeles, CA (US)

( * ) Notice: Subject to any disclaimer, the term of this patent is extended or adjusted under 35 U.S.C. 154(b) by 1435 days.

(21) Appl. No.: 13/752,142

(22) Filed: Jan. 28, 2013

(65) Prior Publication Data

US 2013/0193153 A1 Aug. 1, 2013

Related U.S. Application Data

(60) Provisional application No. 61/591,842, filed on Jan. 27, 2012, provisional application No. 61/649,214, filed on May 18, 2012, provisional application No. 61/732,907, filed on Dec. 3, 2012.

(51) Int. Cl.

| | |
|---|---|
| ***B65D 6/00*** | (2006.01) |
| ***B65D 21/02*** | (2006.01) |
| ***B65D 6/18*** | (2006.01) |
| ***B65D 25/00*** | (2006.01) |
| ***B65D 25/30*** | (2006.01) |

(52) U.S. Cl.

CPC ..... *B65D 21/0209* (2013.01); *B65D 11/1833* (2013.01); *B65D 11/20* (2013.01); *B65D 21/0212* (2013.01); *B65D 25/005* (2013.01); *B65D 25/30* (2013.01)

(58) Field of Classification Search

CPC . B65D 7/40; B65D 5/16; B65D 25/10; B65D 25/005; B65D 21/062

See application file for complete search history.

(56) References Cited

U.S. PATENT DOCUMENTS

| | | | | |
|---|---|---|---|---|
| 705,045 | A * | 7/1902 | Davidson | 312/297 |
| 1,779,159 | A * | 10/1930 | Coe | 220/252 |
| 5,785,328 | A * | 7/1998 | Eckloff | 280/33.998 |
| 5,924,572 | A * | 7/1999 | Cope | 206/518 |
| 6,170,689 | B1 * | 1/2001 | Flesher et al. | 220/7 |
| 6,227,398 | B1 * | 5/2001 | Yang et al. | 220/9.4 |
| 6,318,579 | B1 * | 11/2001 | Leess | 220/345.2 |
| 6,601,724 | B1 | 8/2003 | Koefelda et al. | |
| 6,702,135 | B2 * | 3/2004 | Pickler | 220/1.5 |
| 8,397,618 | B2 * | 3/2013 | White et al. | 89/36.01 |

FOREIGN PATENT DOCUMENTS

| | | |
|---|---|---|
| DE | 10 2008 024171 A1 | 12/2009 |
| EP | 2 030 903 A1 | 3/2009 |
| GB | 2 449 502 A | 11/2008 |

OTHER PUBLICATIONS

European Search Report for EP Application No. 13152902.6, dated May 15, 2013.

* cited by examiner

*Primary Examiner* — Jeffrey R Allen

(74) *Attorney, Agent, or Firm* — Carlson, Gaskey & Olds, P.C.

(57) ABSTRACT

A collapsible container includes a base and a plurality of walls pivotable between an upright position and a collapsed position on the base. A first wall includes an opening therethrough. A first door selectively covers the opening through the first wall. In one embodiment, the first door is slidable between an open, retracted position away from the opening and a closed position covering the opening.

18 Claims, 48 Drawing Sheets

COLLAPSIBLE CONTAINER WITH DOOR

BACKGROUND

The present invention relates generally to a collapsible crate and more particularly to a collapsible crate providing access to the interior when the crate is stacked.

Fresh produce, such as strawberries, is sometimes shipped in corrugated cardboard boxes. The produce may be shipped in plastic clamshell containers, a plurality of which are placed in each cardboard box. The boxes are then stacked for shipping.

The boxes may be randomly inspected by cutting a hole in a wall of the one of the boxes so that one or more of the plastic clamshell containers can be removed for inspection of the produce. The inspection is not limited to the boxes at the top of the stack. The inspector may randomly cut a hole in the side of a box anywhere in the stack.

SUMMARY

A container includes a base and a plurality of walls. A first wall includes an opening therethrough. A first door selectively covers the opening through the first wall. In one embodiment, the first door is slidable between an open, retracted position away from the opening and a closed position covering the opening. In another embodiment, the door is pivotably connected to the side wall.

In several embodiments, the container is a collapsible container, such that the walls are pivotable between an upright position and a collapsed position on the base.

DETAILED DESCRIPTION OF THE PREFERRED EMBODIMENTS

Figure 1:
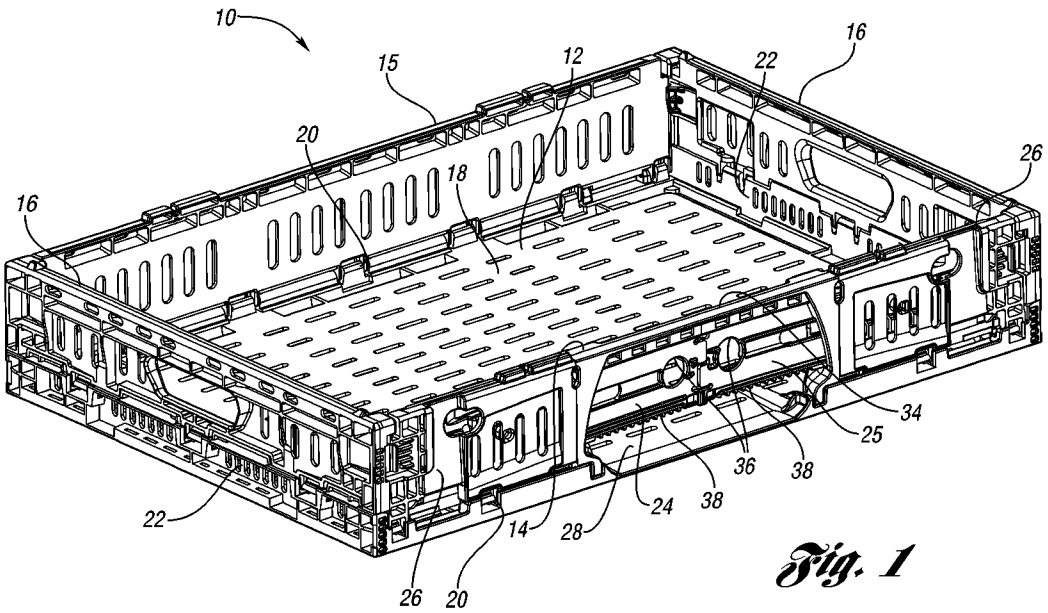
FIG. 1 is a perspective view of a collapsible container according to a first embodiment.

FIG. 1 shows a crate 10 according to one embodiment of the present invention. The crate 10 includes a base 12, front wall 14, rear wall 15 and end walls 16. The base 12 includes an upper panel 18 having ventilation openings therethrough, side hinge members 20 to which the front and rear walls 14, 15 are hingeably connected and end upstanding portions 22 to which the end walls 16 are hingeably connected.

The front wall 14 includes a pair of slidable doors 24, 25 to facilitate access to the interior of the crate 10 when other crates 10 (not shown) are stacked thereon. The front wall 14 includes outer wall portions 26 with a rail portion 34 therebetween defining an opening therebelow. The doors 24, 25 are slidably mounted in the opening below the rail portion 34. Handle openings 36 are formed through the doors 24, 25 to facilitate opening and closing the doors 24, 25. Teeth 38 may be formed at lower edges of the doors 24, 25 to discourage use of the doors 24, 25 as handles for lifting the crate 10. A downwardly sloped portion 28 of the base 12 is positioned below the doors 24, 25. Although the crate 10 will be described and shown only as having doors 24, 25 formed in the side wall 14, doors 24, 25 could also be provided in the side wall 15 and/or end walls 16.

Figure 2:
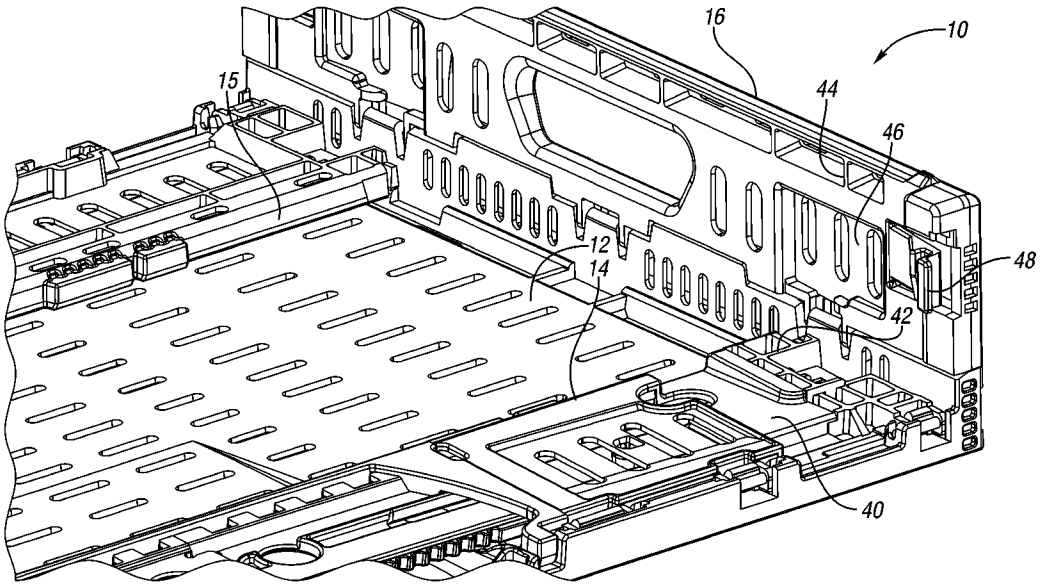
FIG. 2 shows an enlarged view of one half of the container of FIG. 1 with the side walls collapsed.
Figure 3:
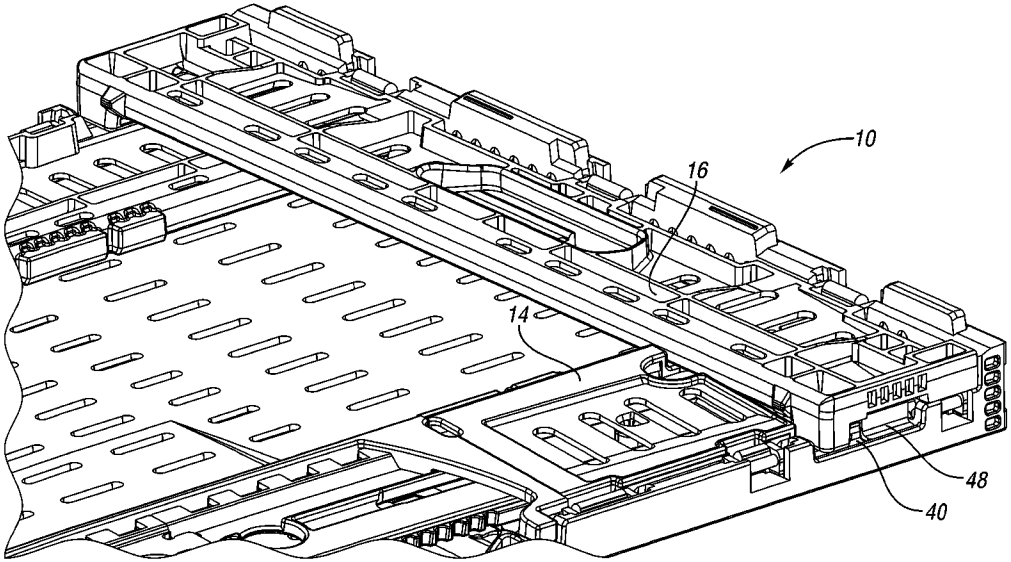
FIG. 3 shows an enlarged view of one half of the container of FIG. 1 in a collapsed position.

As shown in FIG. 2, the front wall 14 and rear wall 15 can be collapsed onto the base 12. As will be explained below, the front wall 14 may be a little thicker than the rear wall 15 and may not lie completely parallel to the base 12. Therefore, some features are incorporated to facilitate the ability for the end walls 16 to be collapsed onto the front wall 14. First, an exterior surface of the front wall 14 includes a recess 40 adjacent a projecting portion 42. The interior surface of the end wall 16 includes a projecting portion 44 adjacent a recess 46 and a latch 48. These are aligned such that the projecting portion 44 and latch 48 of the end wall 16 will be received in the recess 40 on the front wall 14 and such that the projecting portion 42 will be received in the recess 46 of the end wall 16, as shown in FIG. 3.

Figure 4:
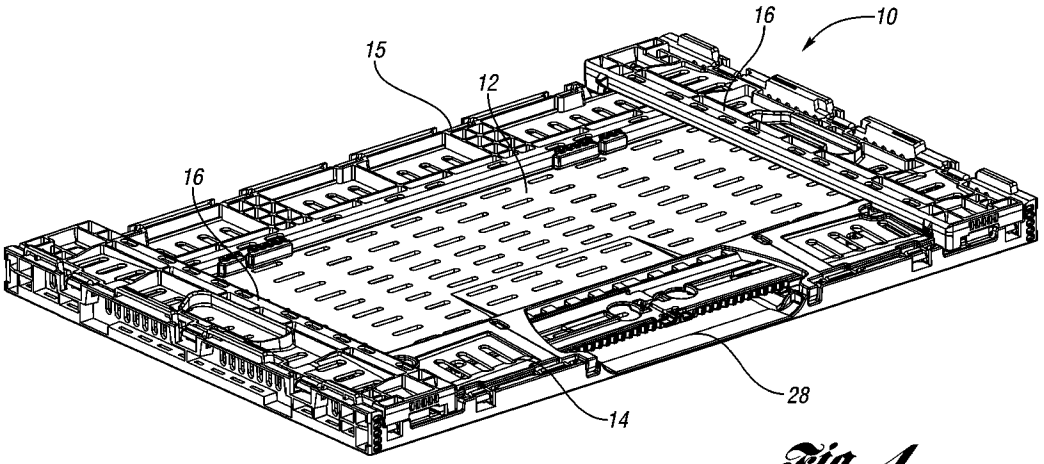
FIG. 4 is a perspective view of the container of FIG. 1 in a collapsed position.

As shown in FIG. 4, the crate 10 can be collapsed for efficient shipping and storage when empty. The front wall 14 and rear wall 15 are pivoted onto the base 12, and the end walls 16 are pivoted onto the front wall 14 and rear wall 15. The doors 24, 25 on the front wall 14 can be open or closed in the collapsed position.

Figure 5:
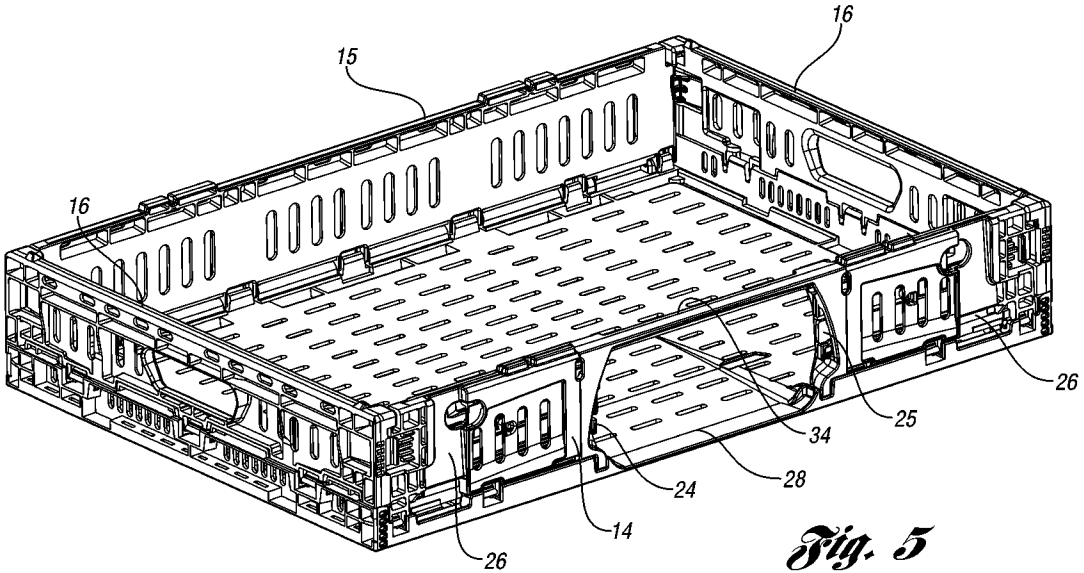
FIG. 5 shows the container of FIG. 1 with the doors open.

FIG. 5 shows the crate 10 in the use position with the walls in the upright assembled position. In FIG. 5, the doors 24, 25 are open, i.e. they are slid away from one another adjacent the outer wall portions 26 of the front wall 14. This provides the opening below the rail 34 through which the interior of the crate 10 can be accessed. The downwardly sloped portion 28 of the base 12 partially defines the opening below the rail 34.

Figure 6:
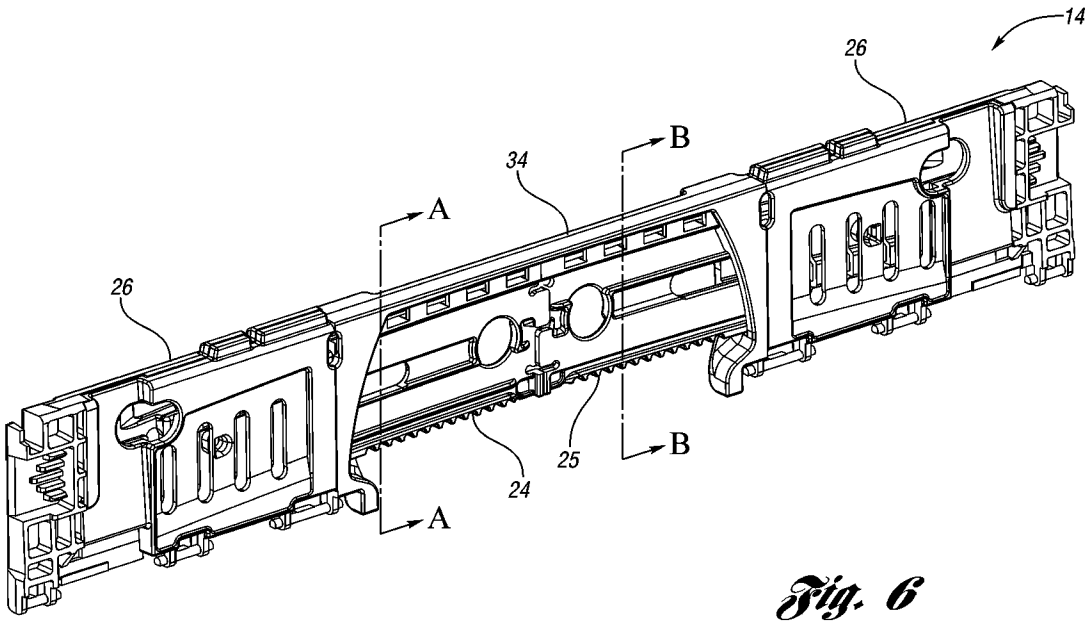
FIG. 6 is an exterior perspective view of the front wall with the doors closed.
Figure 7:
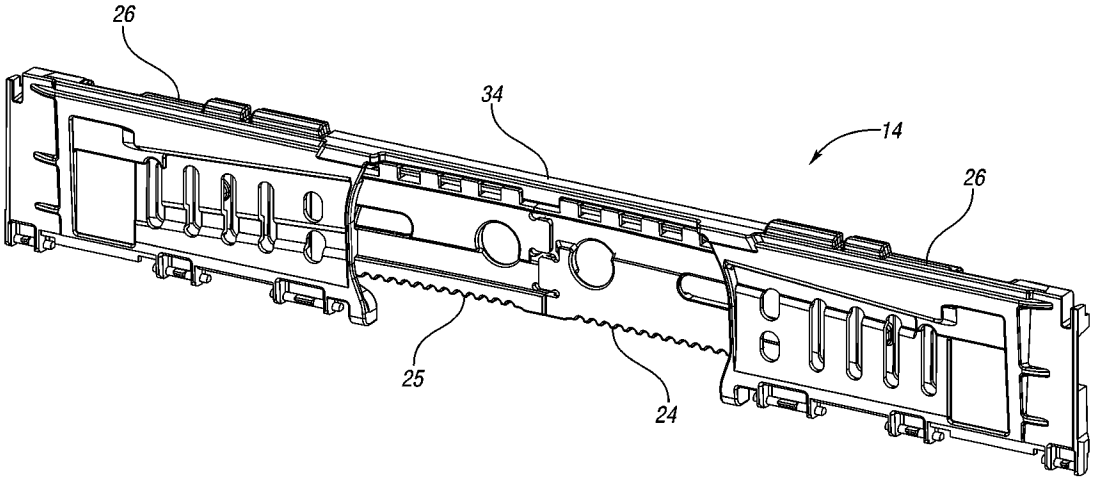
FIG. 7 is an interior perspective view of the front wall of FIG. 6.

FIG. 6 is an exterior perspective view of the front wall 14 with the doors 24, 25 closed. FIG. 7 is an interior perspective view of the front wall 14 of FIG. 6.

Figure 8:
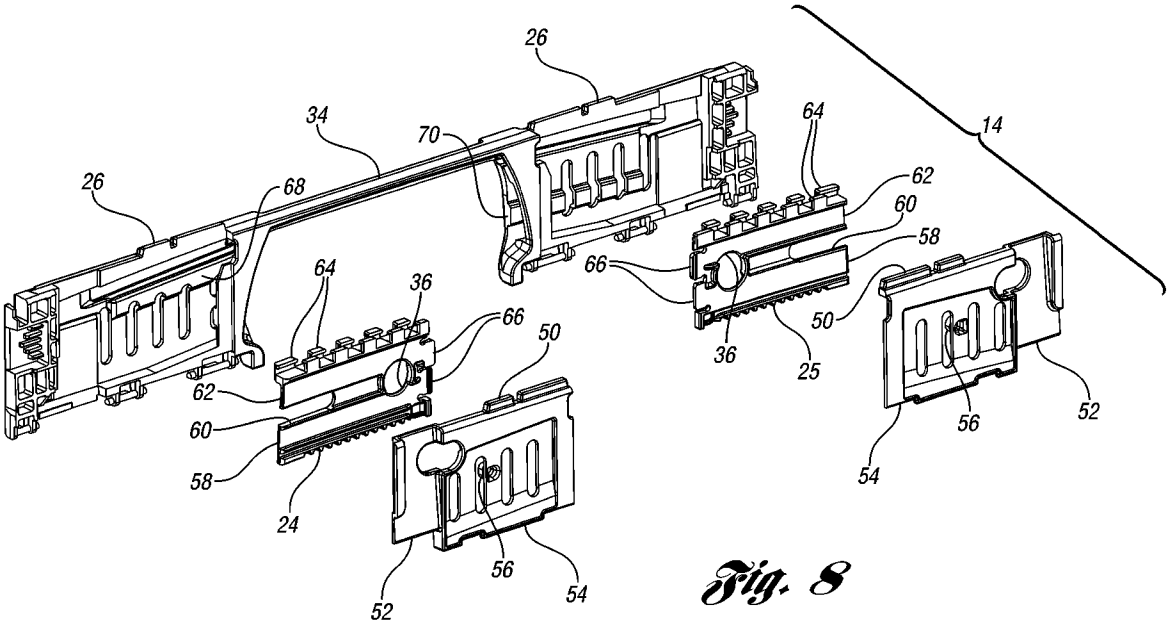
FIG. 8 is an exploded exterior perspective view of the front wall.
Figure 9:
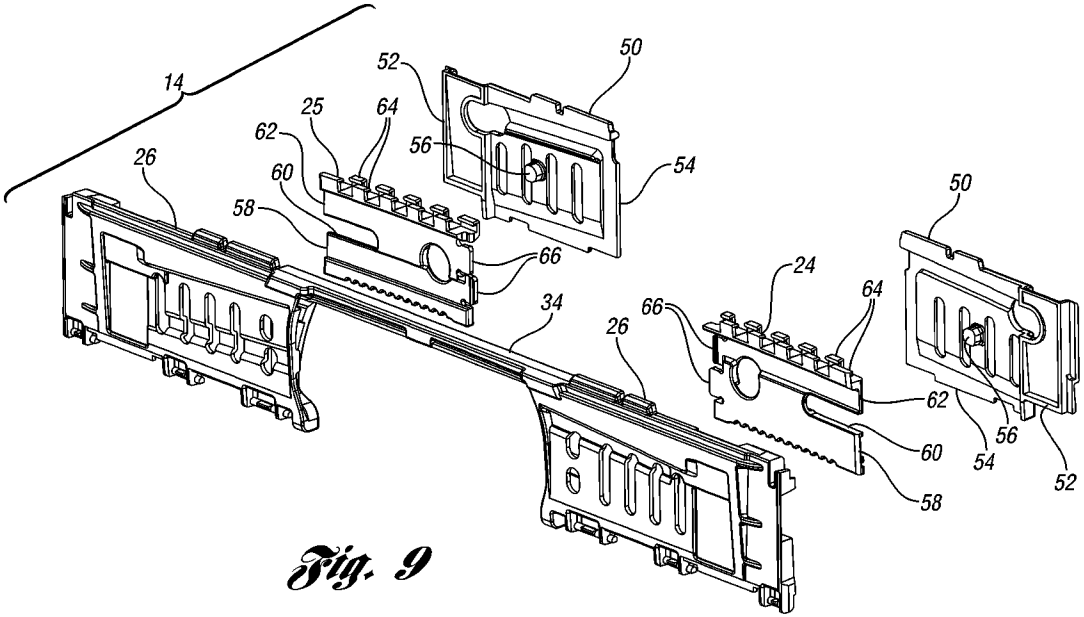
FIG. 9 is the interior perspective view of FIG. 8.

FIG. 8 is an exploded exterior perspective view of the front wall 14 and FIG. 9 is the interior perspective view of FIG. 8. The front wall 14 includes the outer wall portions 26 integrally molded as a single piece of plastic with the rail portion 34 therebetween defining an opening therebelow. Outer covers 50 each include an attachment portion 52 and a cover portion 54. The cover portions 54 are between the attachment portions 52 and offset toward the exterior relative to the attachment portions 52. A post 56 projects rearwardly from each cover portion 54.

Each door 24, 25 includes a lower portion 58 from which the teeth 38 descend. Each door 24, 25 includes a middle slot 60 above the lower portion 58 opening outward (i.e. away from the other door). An upper portion 62 extends above each middle slot 60 and is connected to the lower portion 58 by portions surrounding the handle openings 36. Alternating teeth 64 project upward from the upper portion 62. Latch members 66 protrude from the inner edges of the doors 24, 25. Each outer wall portion 26 includes an interlocking ridge portion 68, 70, respectively, protruding toward the exterior.

Referring to FIG. 9, the attachment portions 52 and the posts 56 provide attachment surfaces for connecting the outer covers 50 to the outer wall portions 26, such as by vibration welding, adhesive, etc. Most of the perimeter of each cover portion 54 is also secured to the outer wall portions 26.

Figure 10:
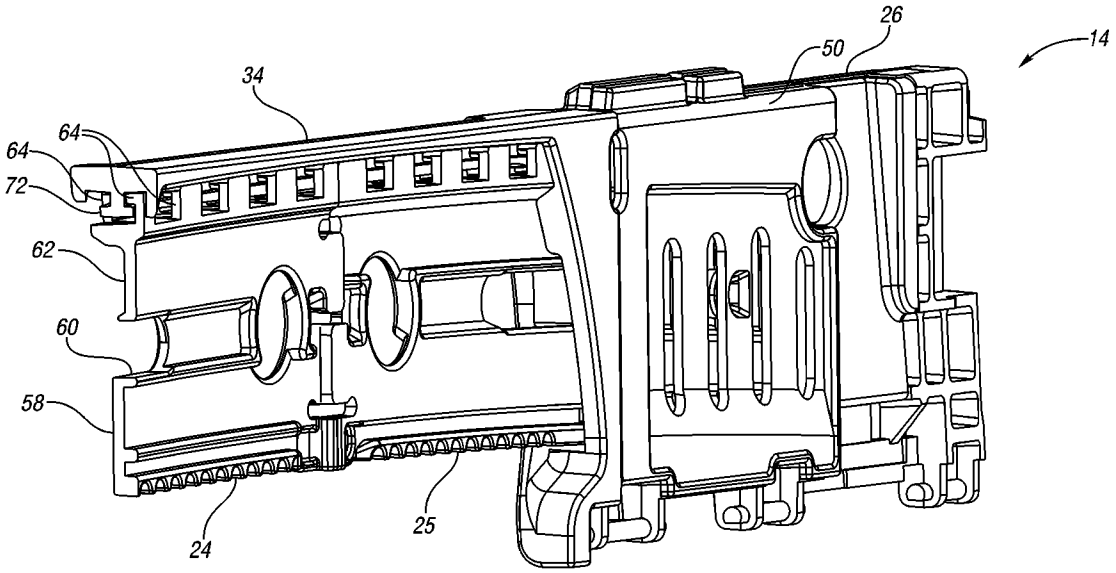
FIG. 10 is a section view taken along line A-A of FIG. 6.

FIG. 10 is a section view taken along line A-A of FIG. 6, through door 24. As shown, the rail 34 includes a downwardly projecting T-shaped rail portion 72. The teeth 64 of the door 24 project upward and then inward toward one another, such that they interlock with the T-shaped rail portion 72. This retains the door 24, especially as it slides to the closed position. The lower portion 58 of the door 24 is offset toward the interior relative to the upper portion 62.

Figure 11:
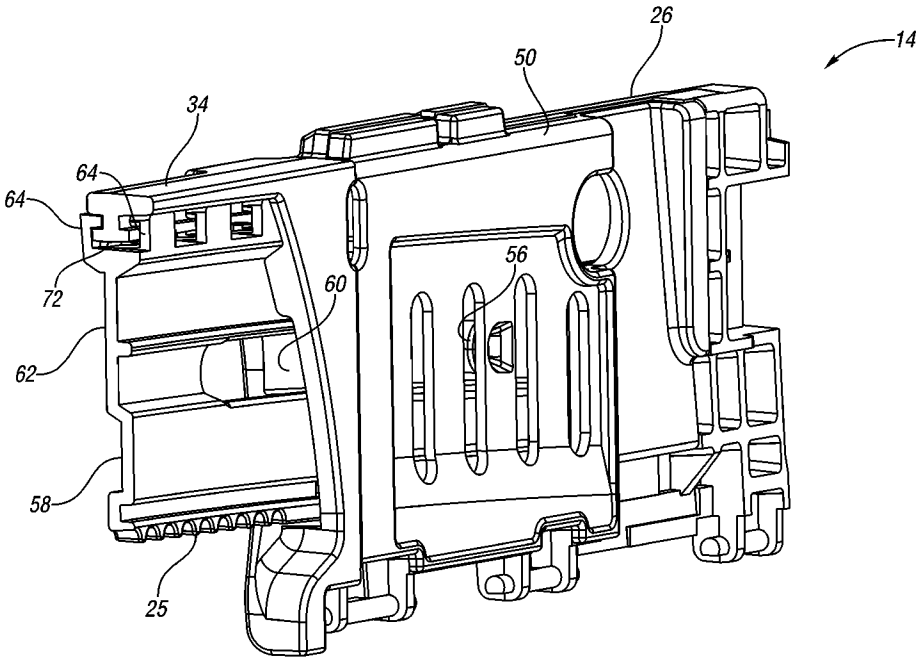
FIG. 11 is a section view taken along line B-B of FIG. 6.

FIG. 11 is a section view taken along line B-B of FIG. 6, through door 25. The teeth 64 of the door 25 project upward and then inward toward one another, such that they interlock with the T-shaped rail portion 72. This retains the door 25, especially as it slides to the closed position. The post 56 is received in the middle slot 60 of the door 25, so that the door 25 can slide open and closed. The lower portion 58 of the door 24 is offset toward the exterior relative to the upper portion 62.

Figure 12:
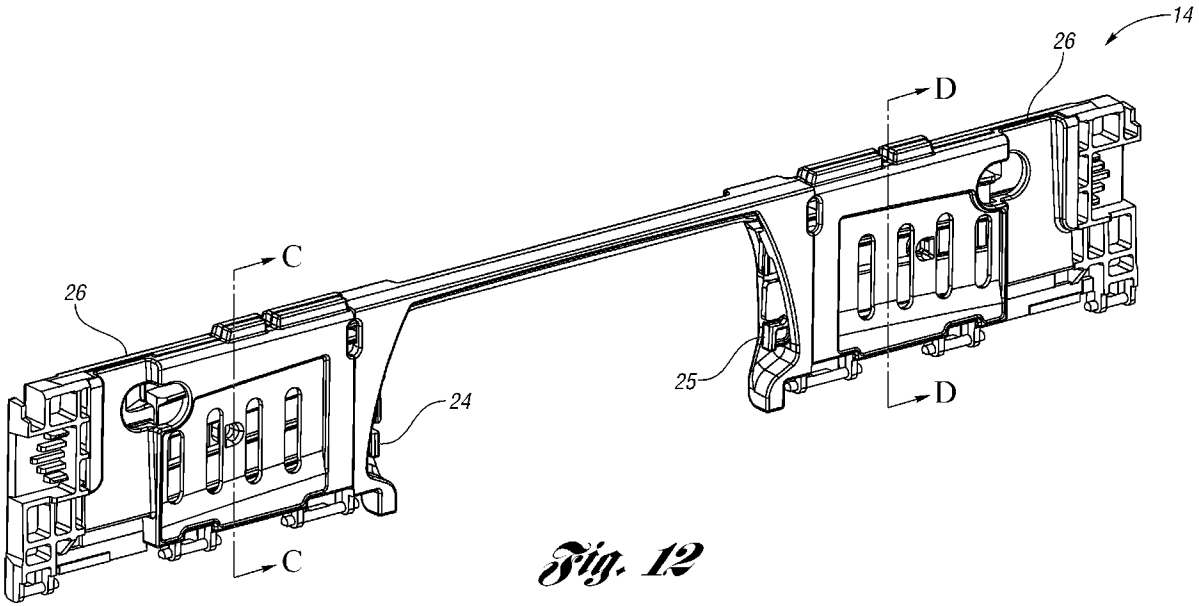
FIG. 12 is a perspective view of the front wall 14 with the doors in the open position.

FIG. 12 is a perspective view of the front wall 14 with the doors 24, 25 in the open position, i.e. slid away from one another and substantially received between the outer wall portions 26 and the outer covers 50.

Figure 13:
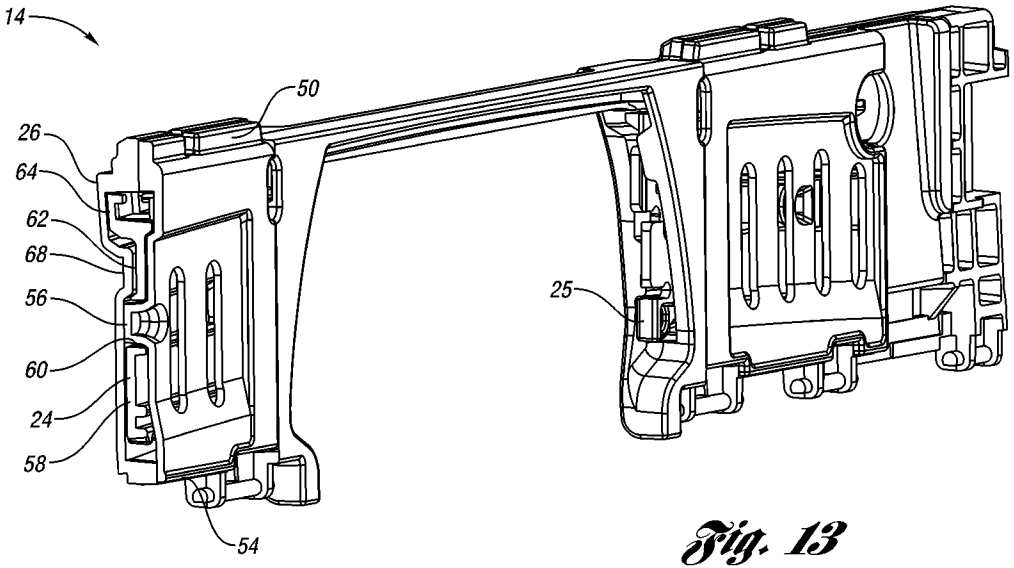
FIG. 13 is a section view taken along line C-C of FIG. 12.

FIG. 13 is a section view taken along line C-C of FIG. 12, through the door 24. The post 56 is slidably received in the middle slot 60 of the door 24. The interlocking ridge 68 engages the upper portion 62 of the door 24 (which is offset toward the exterior).

Figure 14:
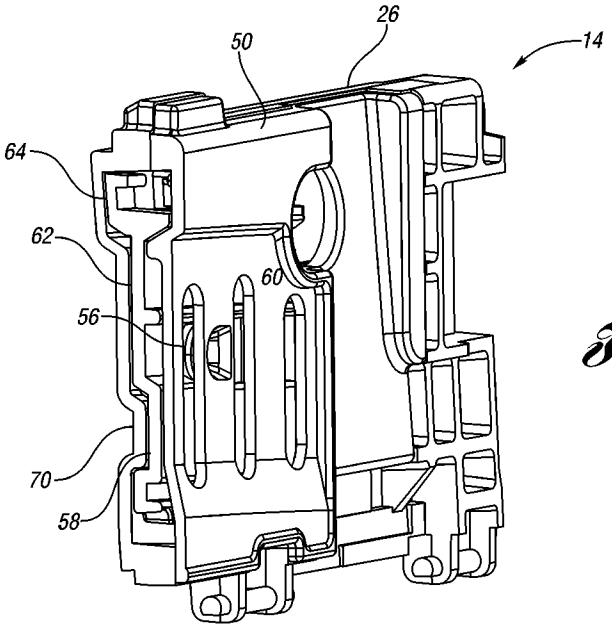
FIG. 14 is a section view taken along line D-D of FIG. 12.

FIG. 14 is a section view taken along line D-D of FIG. 12, through the door 25. The post 56 is slidably received in the middle slot 60 of the door 25. The interlocking ridge 70 engages the lower portion 58 of the door 25 (which is offset toward the exterior).

Figure 15:
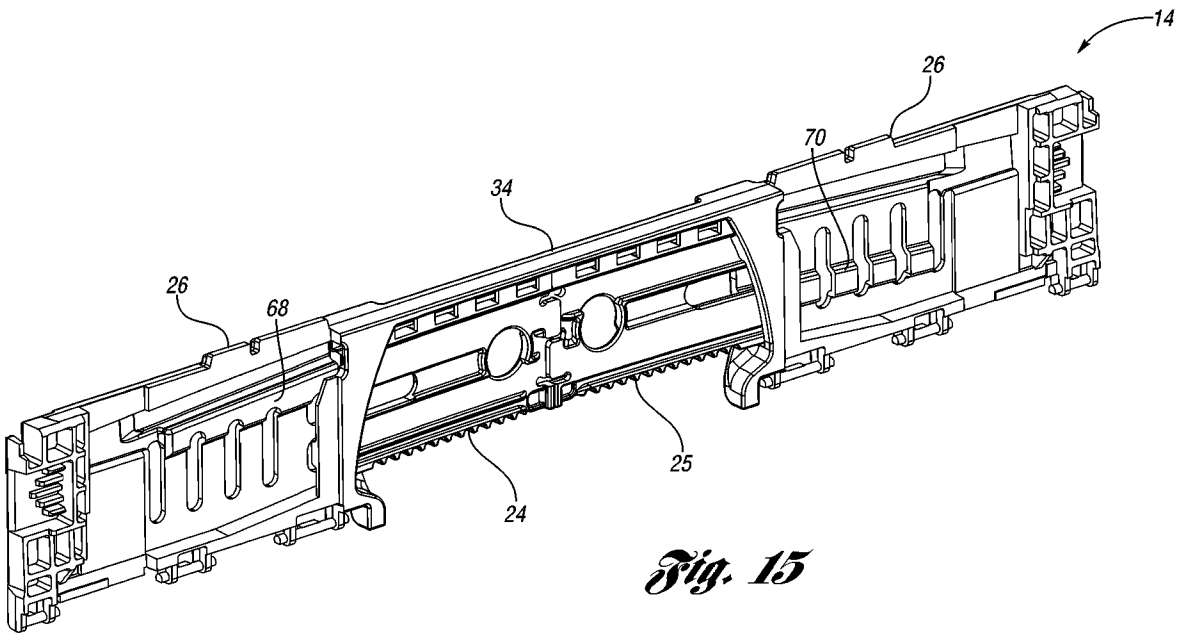
FIG. 15 is an exterior perspective view of the front wall with the outer covers removed and the doors closed.
Figure 16:
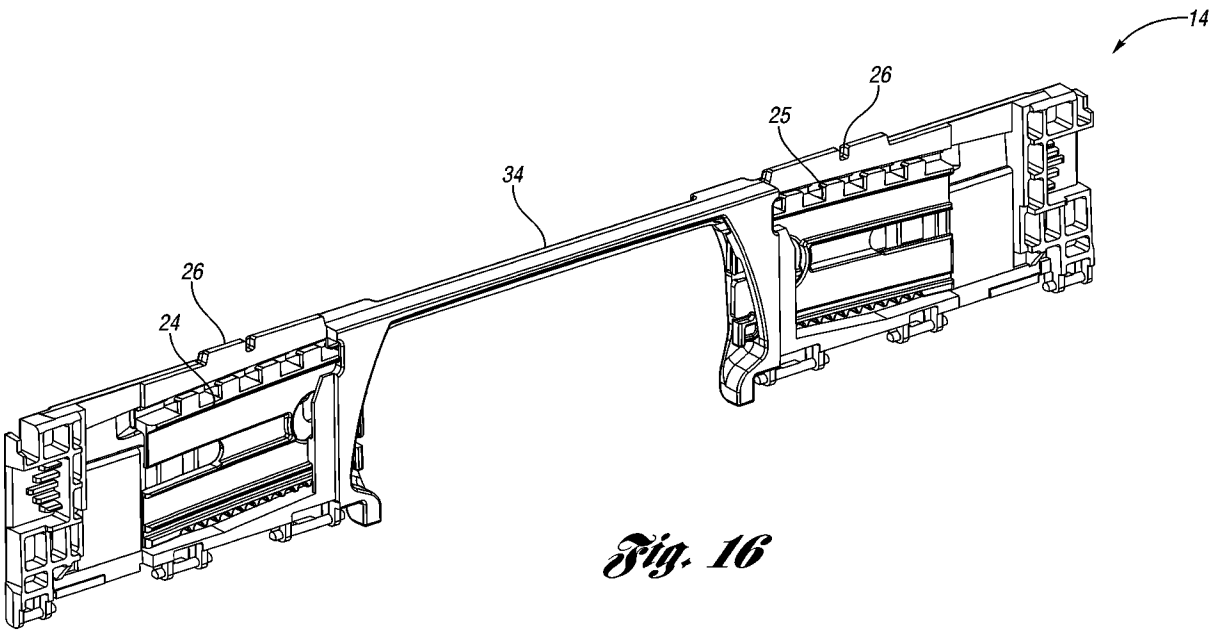
FIG. 16 is an exterior perspective view of the front wall with the outer covers removed and the doors open.

FIG. 15 is an exterior perspective view of the front wall 14 with the outer covers 50 removed and the doors 24, 25 closed. FIG. 16 is an exterior perspective view of the front wall 14 with the outer covers 50 removed and the doors 24, 25 open. As is probably most apparent from FIGS. 15 and 16, the doors 24, 25 move about an arc from the closed position (FIG. 15) down to the open position (FIG. 16).

Figure 17:
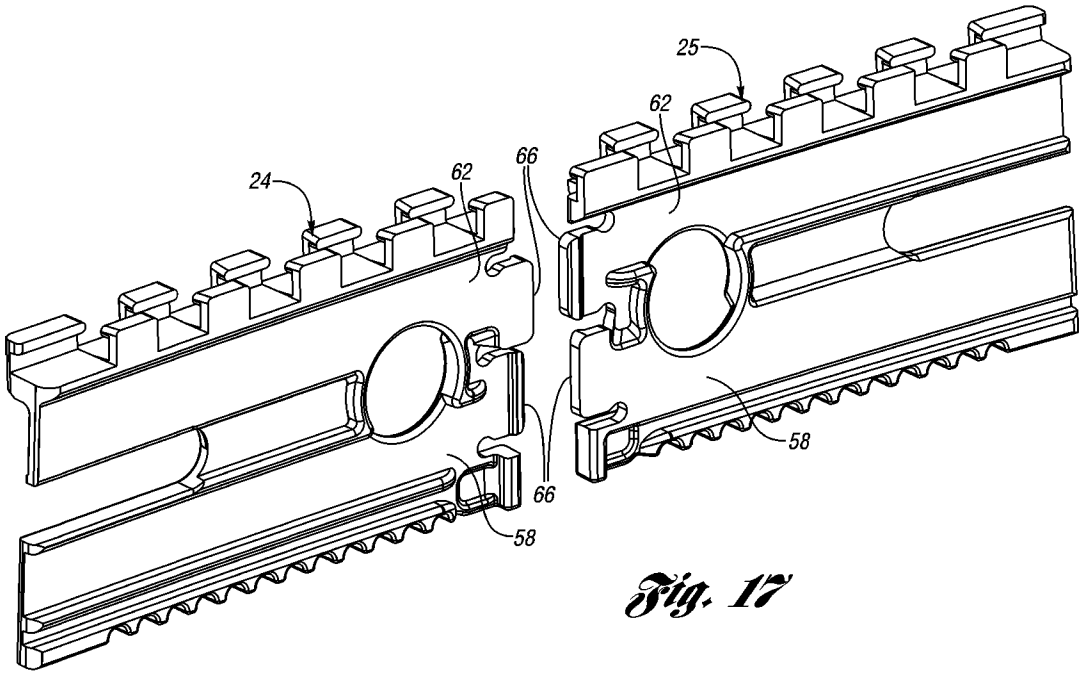
FIG. 17 is an enlarged exterior perspective view of the doors in a position close to engaging one another.
Figure 18:
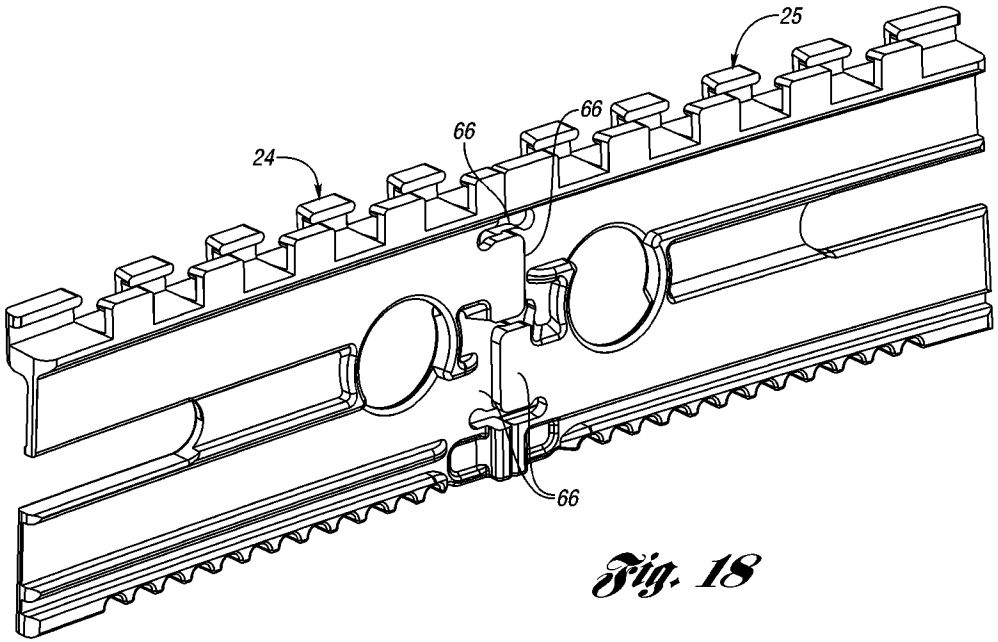
FIG. 18 shows the doors of FIG. 17 latched to one another.

FIG. 17 is an enlarged exterior perspective view of the doors 24, 25 in a position close to engaging one another. As shown, the latches 66 are offset one another, because the upper portion 62 of the door 24 is offset toward the exterior, while the upper portion 62 of the door 25 is offset toward the interior. Similarly, the lower portion 58 of the door 25 is offset toward the exterior while the lower portion 58 of the door 24 is offset toward the interior. The latches 66 include ribs projecting toward one another. Thus, as shown in FIG. 18, the latches 66 can pass next to one another, with the ribs engaging one another to help keep the doors 24, 25 closed.

Figure 19:
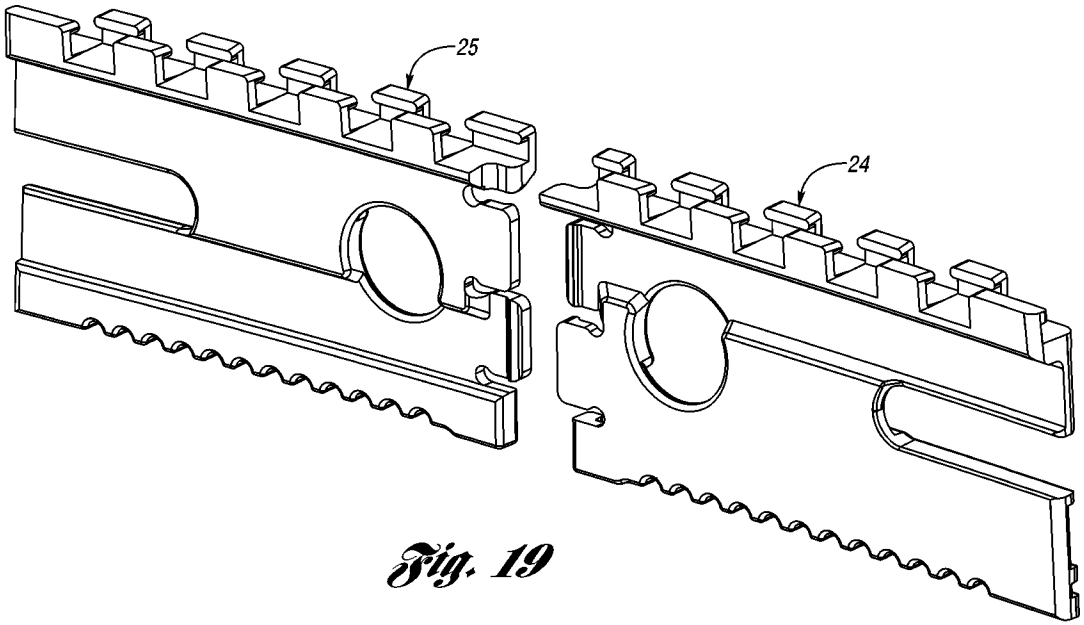
FIG. 19 is an interior perspective view corresponding to FIG. 17.
Figure 20:
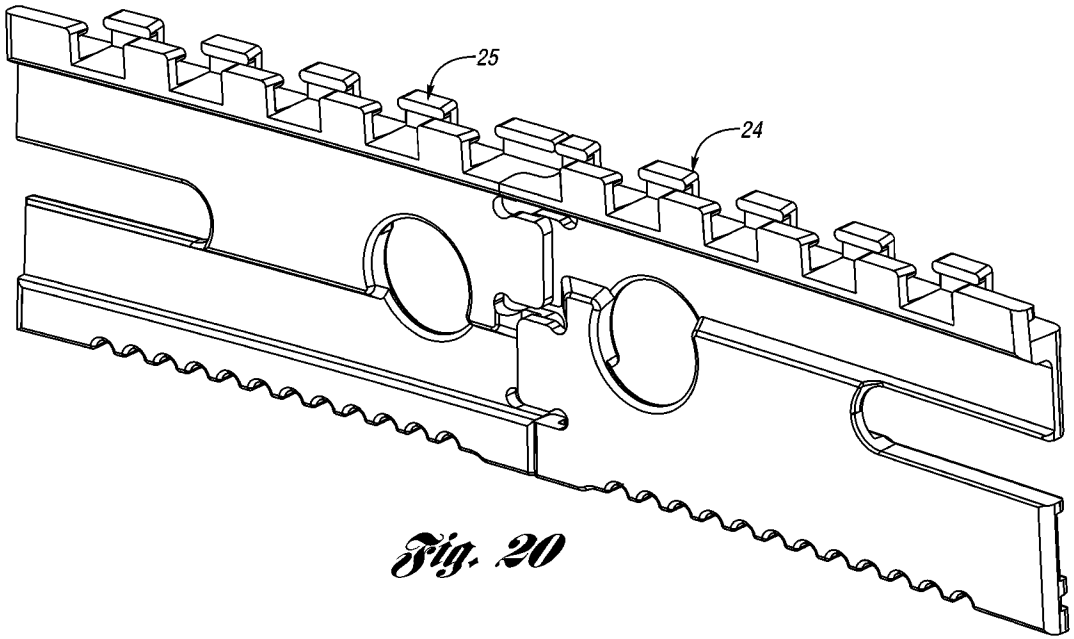
FIG. 20 is an interior perspective view corresponding to FIG. 18.

FIG. 19 is an interior perspective view corresponding to FIG. 17. FIG. 20 is an interior perspective view corresponding to FIG. 18.

Figure 21:
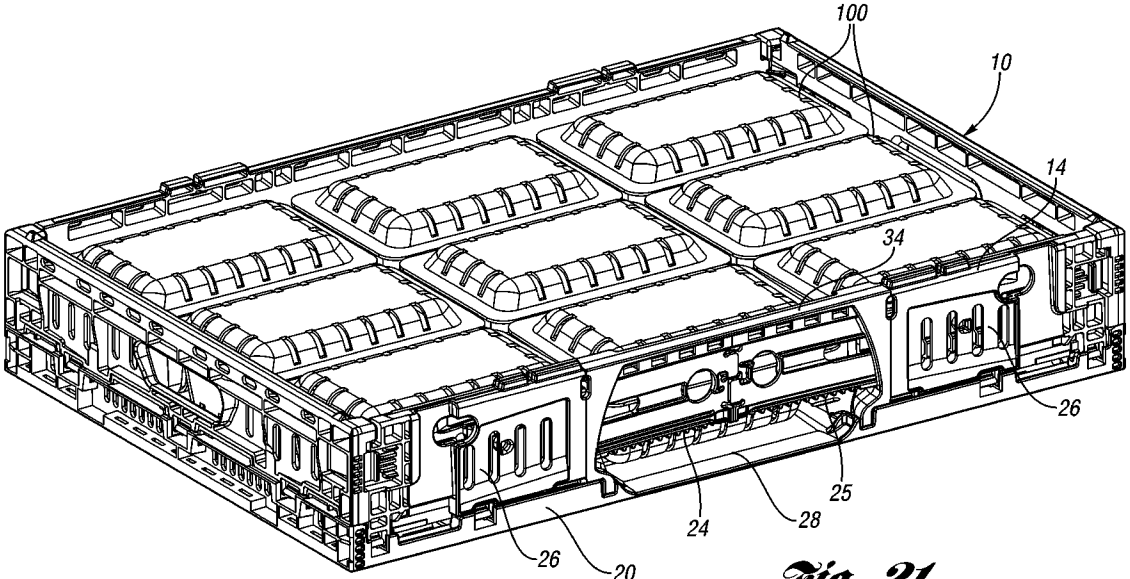
FIG. 21 is a perspective view of the crate with a plurality of containers stored therein.

FIG. 21 is a perspective view of the crate 10 with a plurality of containers 100 stored therein. The containers 100 are retained in the crate 10 by the doors 24, 25. The side upstanding portion 20 includes an opening therethrough aligned with the sloped portion 28 of the base 12 and aligned with the opening in the front wall 14 between the outer wall portions 26.

Figure 22:
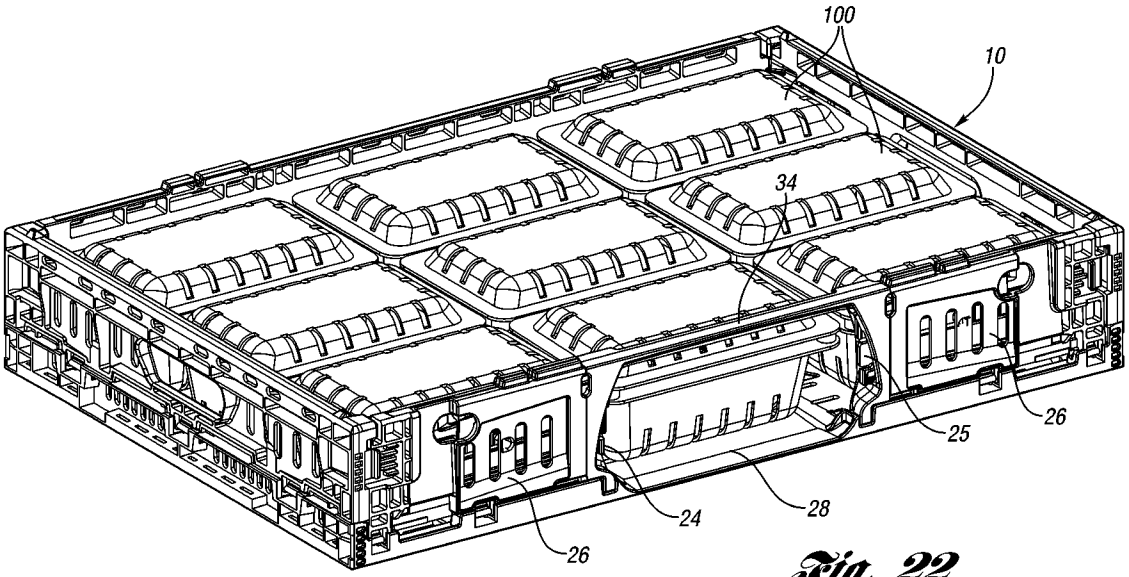
FIG. 22 shows the crate and containers of FIG. 21 with the doors open.
Figure 23:
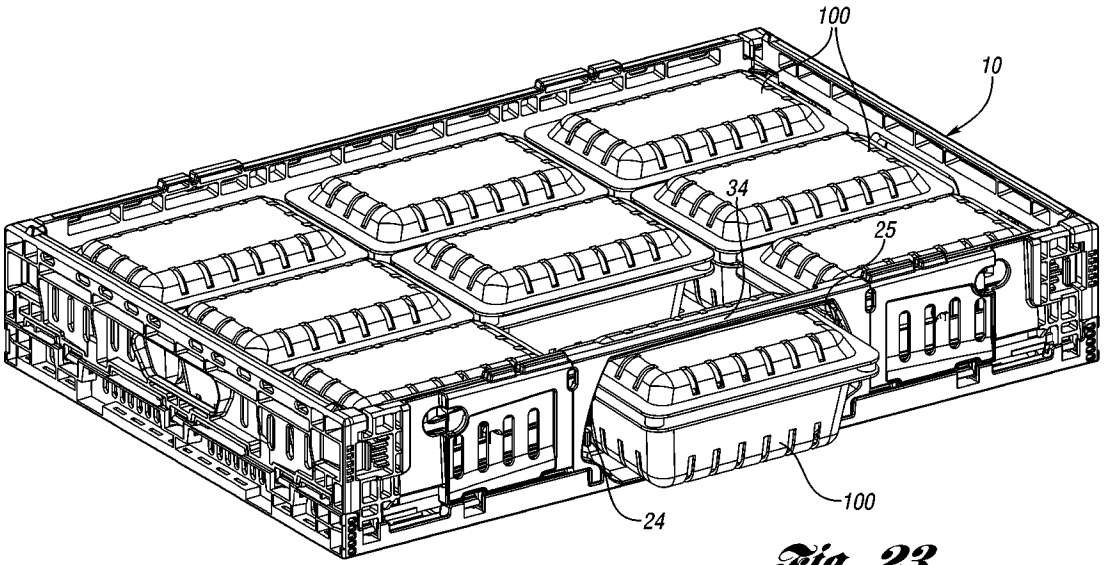
FIG. 23 shows crate and containers of FIG. 22 with a container being removed through the opening.
Figure 24:
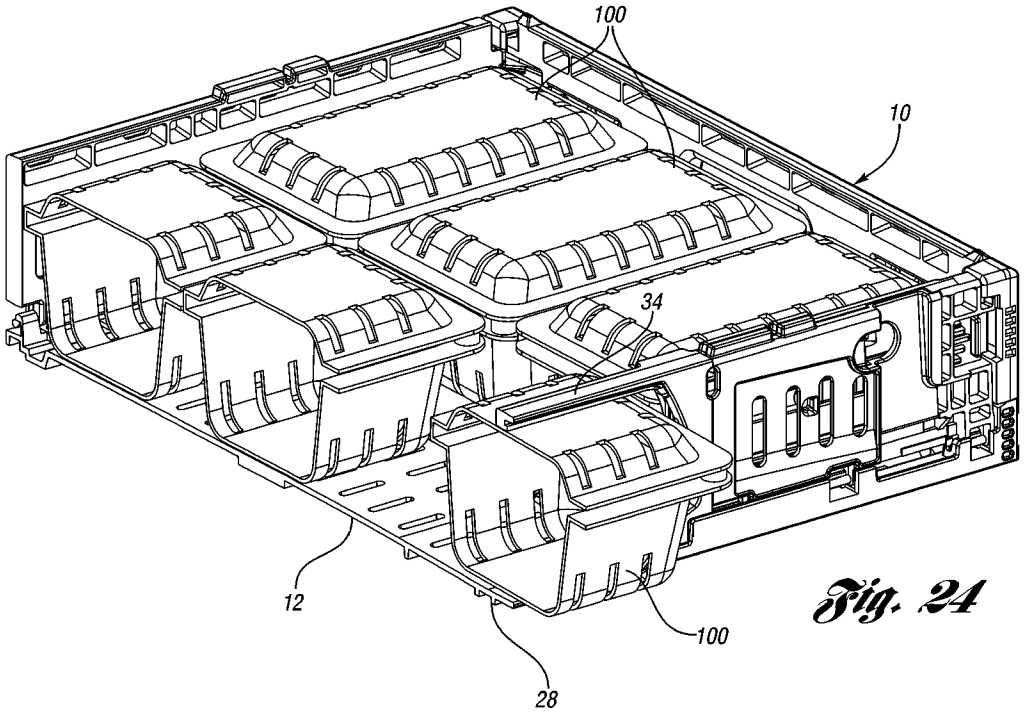
FIG. 24 is a section view through the crate and containers of FIG. 23.

As shown in FIG. 22, the doors 24, 25 can be slid away from each other into the outer wall portions 26. A container 100 can then be removed from the crate 10 through the opening in the front wall 14, as shown in FIGS. 23-24.

Figure 25:
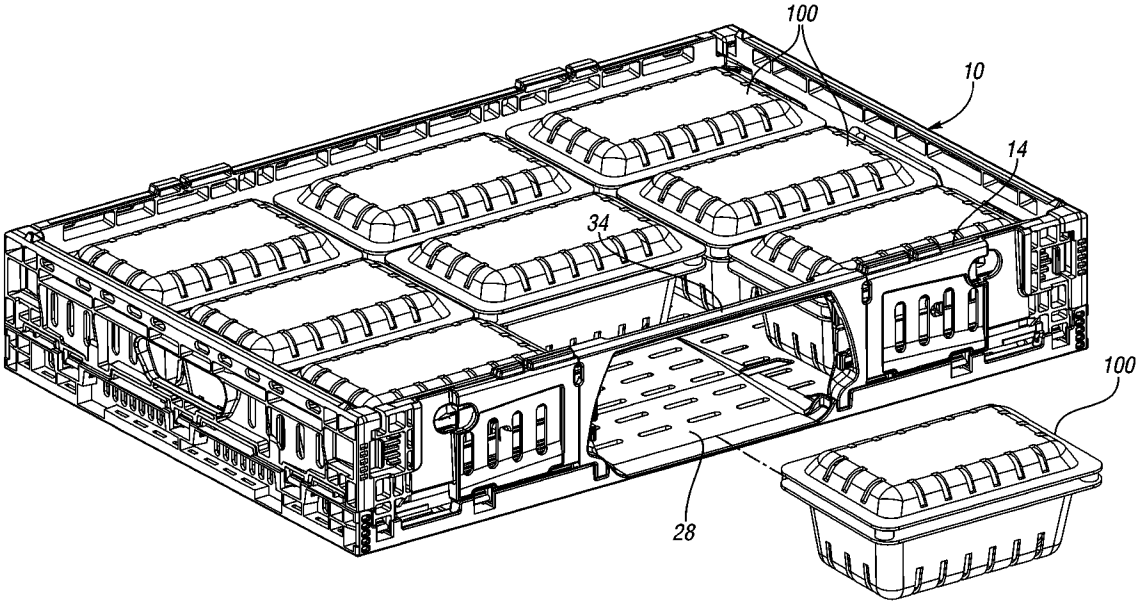
FIG. 25 shows the crate and containers of FIG. 22 with one of the containers removed.

After the container 100 is removed from the crate 10 as shown in FIG. 25, the remainder of the containers 100 can also be removed, one at a time, through the opening in the front wall 14.

Figure 26:
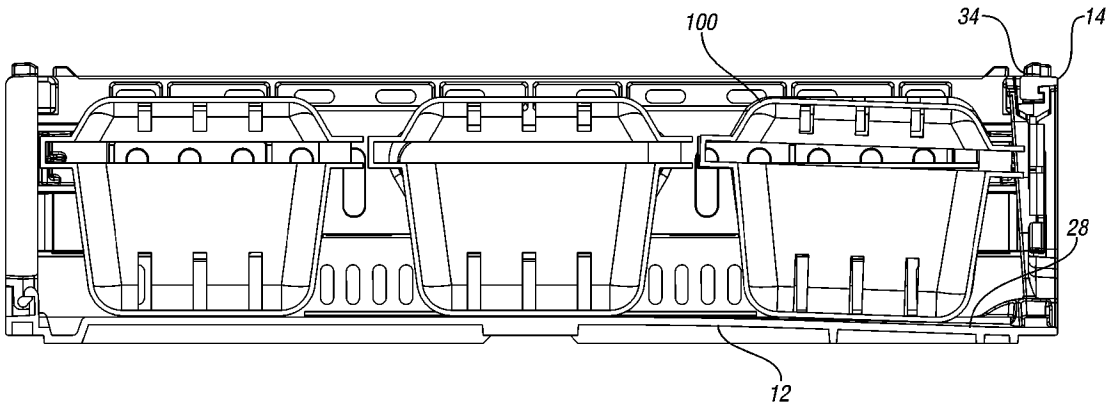
FIGS. 26-28 are section views through the crate and containers of FIG. 22, showing a series of steps to remove a container.
Figure 27:
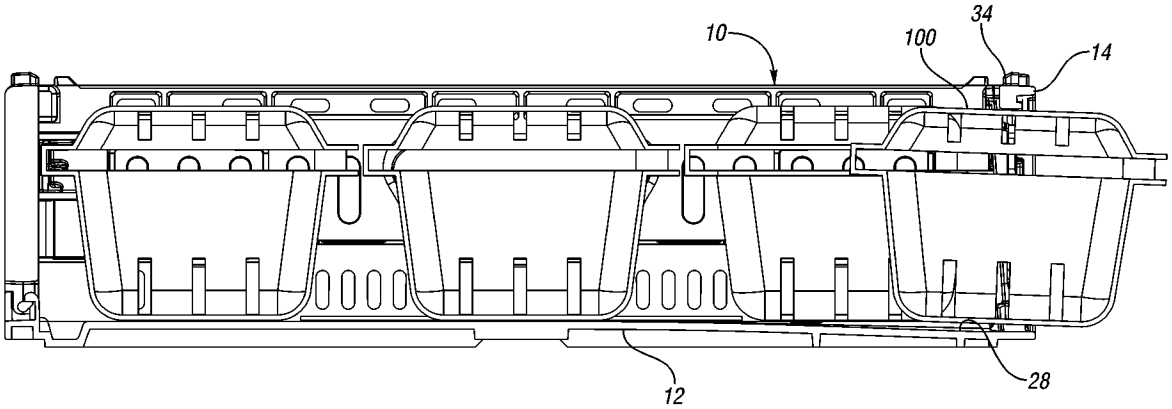
Figure 28:
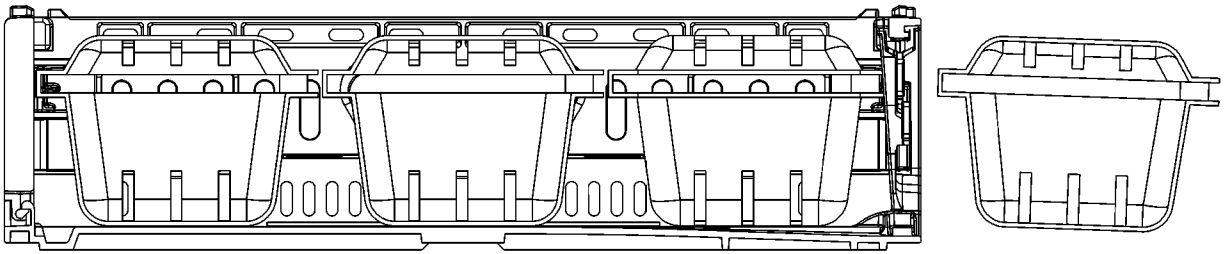

As shown in FIGS. 26-28, the sloped portion 28 of the base 12 helps fit the containers 100 below the rail 34.

Figure 29:
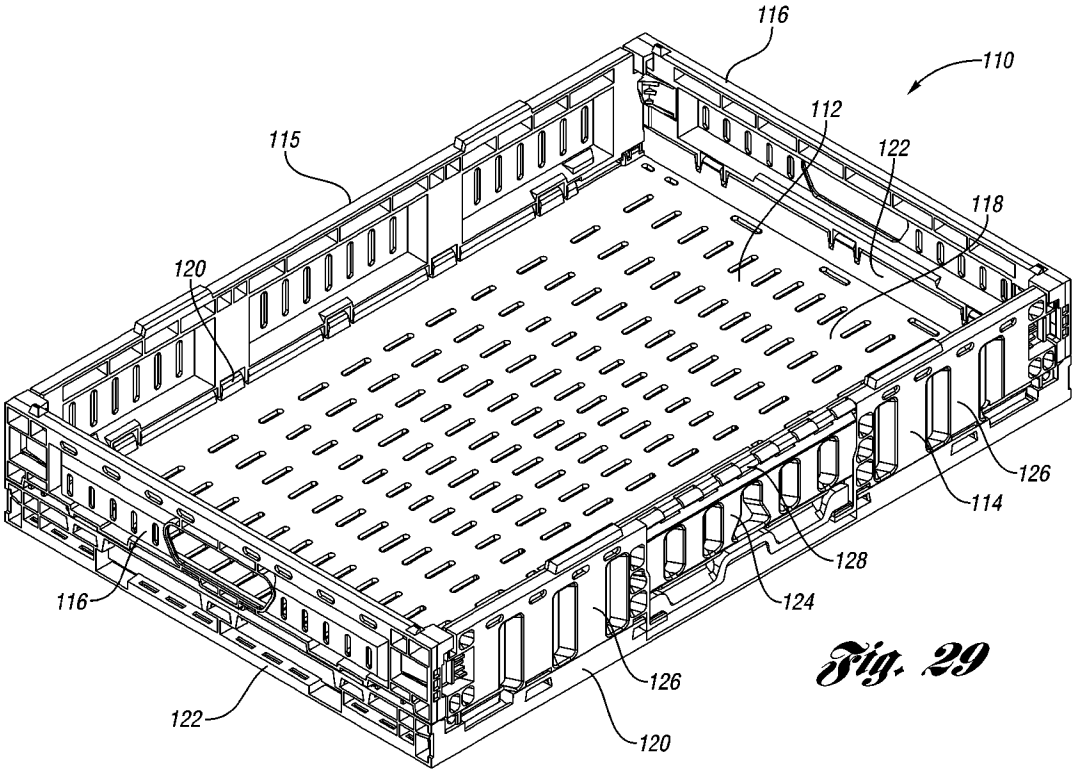
FIG. 29 is a perspective view of a collapsible crate according to a second embodiment.

A collapsible crate 110 according to a second embodiment is shown in FIGS. 29-41. Referring to FIG. 29, the crate 110 includes a base 112 to which side walls 114, 115 and end walls 116 are pivotably connected. The base 112 includes an upper panel 118 having ventilation openings therethrough, side upstanding portions 120 to which the side walls 114, 115 are hingeably connected and end upstanding portions 122 to which the end walls 116 are hingeably connected.

The side wall 114 (the "front" wall) includes a door 124 that can be selectively opened to access the interior of the crate 110 through the side wall 114. Although the crate 110 will be described and shown only as having a door 124 formed in the side wall 114, doors 124 could also be provided in the side wall 115 and/or end walls 116.

The door 124 is positioned between outer wall portions 126 of the side wall 114. The outer wall portions 126 are connected by a rail 128 extending therebetween. The rail 128 defines an upper edge of the side wall 114. The door 124 is pivotably connected to the rail 128.

Figure 30:
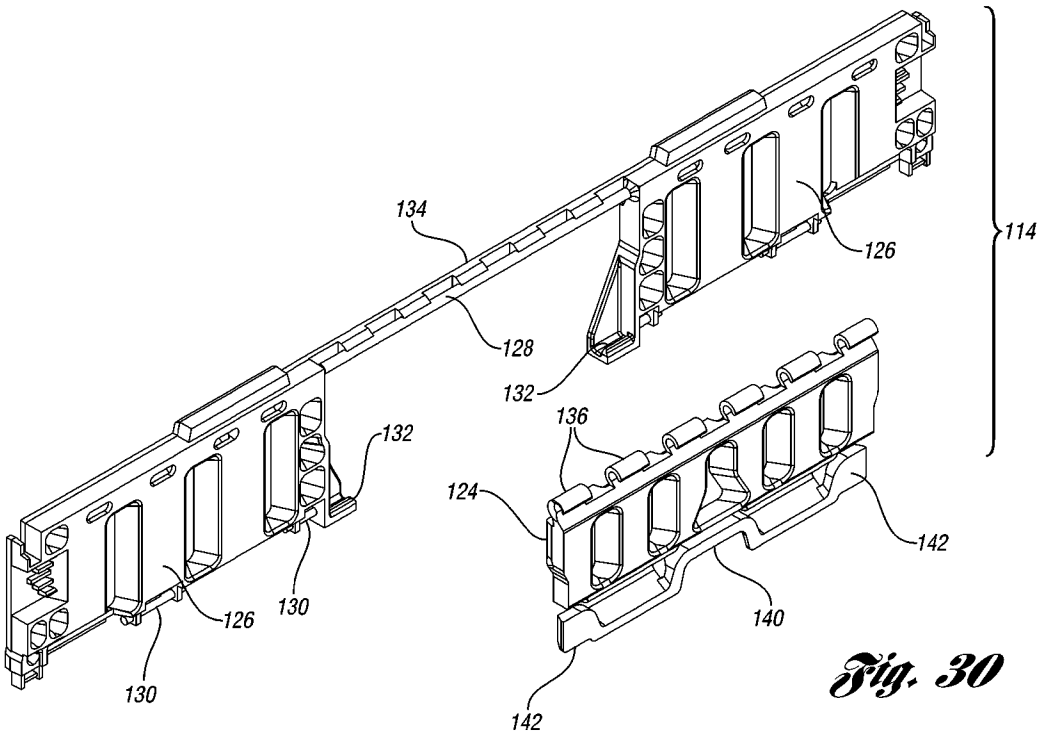
FIG. 30 is an exploded view of the side wall of the crate of FIG. 29.

FIG. 30 is an exploded view of the side wall 114. As shown, the outer wall portions 126 are integrally molded as a single piece of plastic with the rail 128 and a support bar 134, which both extend between the outer wall portions 126. Hinge pins 130 are formed below each outer wall portion 126 for pivotably connecting to the side upstanding portions 120 of the base 112 (FIG. 29). An opening is defined between the outer wall portions 126. An interlocking portion 132 projects into the opening from each outer wall portion 126.

The door 124 includes hinge members 136 that can snap-fit and pivotably connect to the rail 128. The door 124 further includes a handle portion 140 having outer tabs 142. The handle 140 and tabs 142 can be flexed relative to the remainder of the door 124, such that the tabs 142 can be selectively removed from interlocking with the interlocking portions 132 so that the door 124 can be opened.

Figure 31:
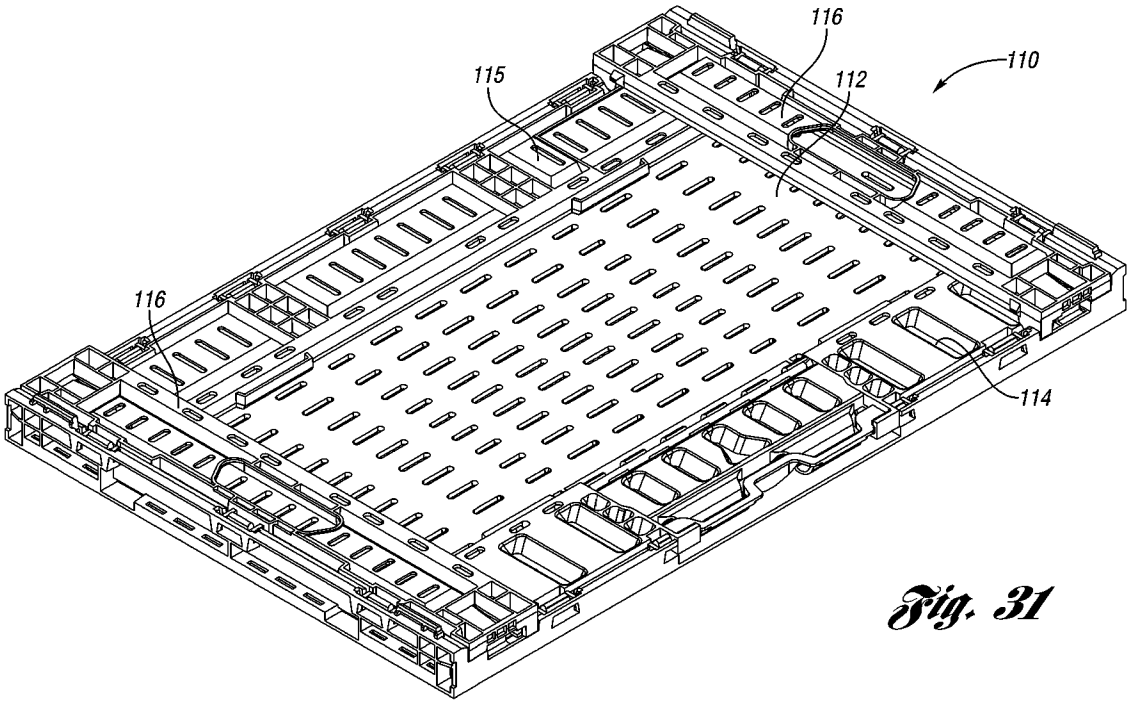
FIG. 31 shows the crate of FIG. 29 in a collapsed position.

As shown in FIG. 31, the side walls 114, 115 and end walls 116 can be pivoted to a collapsed position on the base 112 when the crate 110 is empty.

Figure 32:
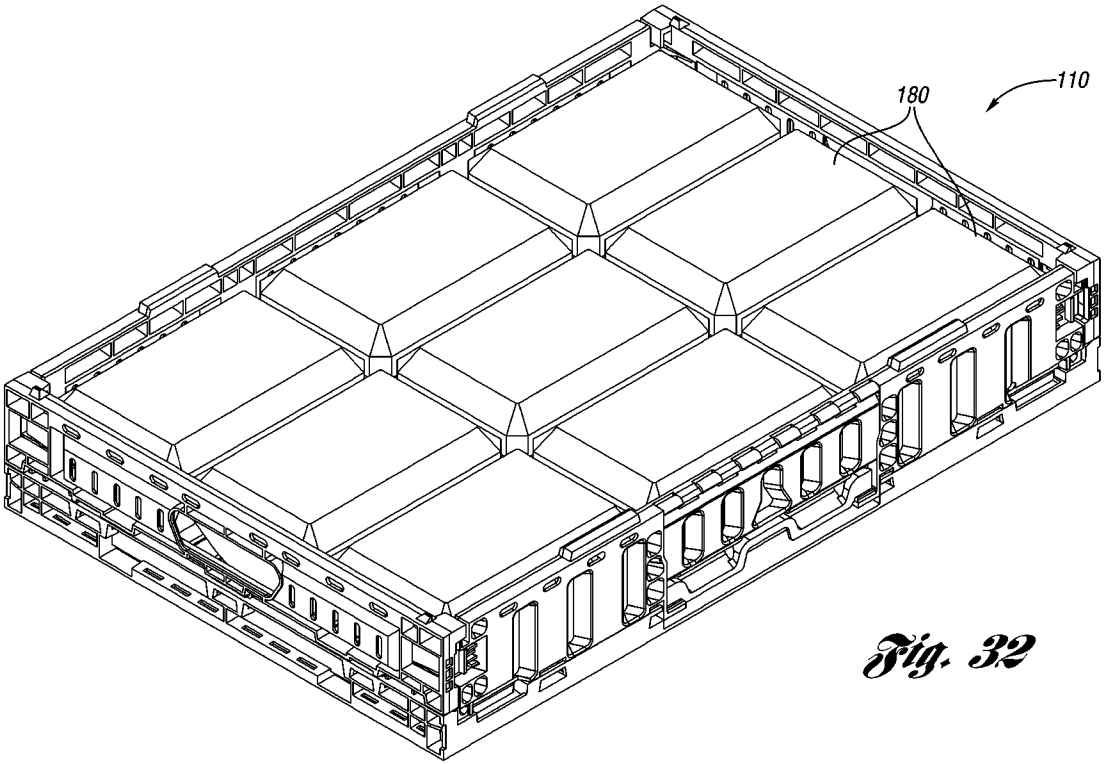
FIG. 32 shows the crate loaded with a plurality of containers.

FIG. 32 shows the crate 110 loaded with a plurality of containers 180. In the example shown, the containers 180 are plastic "clam shell" containers 180, such as might contain fresh fruit, such as strawberries (the containers 180 would have many openings for ventilation).

Figure 33:
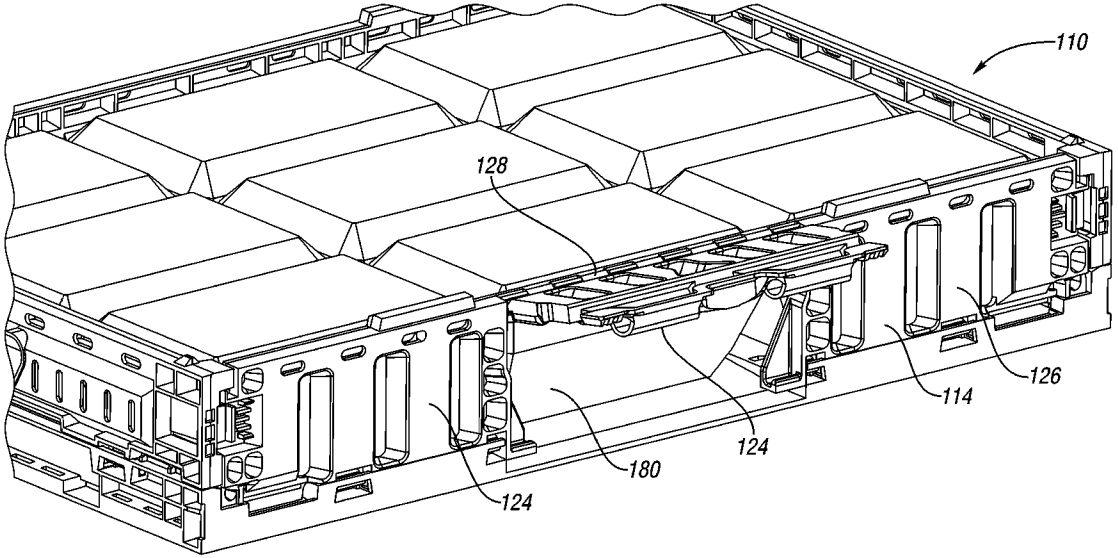
FIG. 33 shows the crate and containers with the door pivoted to an open position.

FIG. 33 shows the crate 110 and containers 180 with the door 124 pivoted to an open position. When the door 124 is an open position, the containers 180 can be removed from the crate 110 through the opening in the side wall 114.

Figure 34:
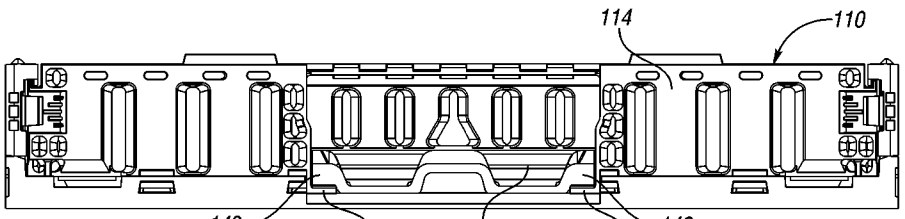
FIG. 34 is a side view of the crate and containers of FIG. 32 with the door in the closed position.

FIG. 34 shows the side wall 114 with the door 124 in the closed position, with the tabs 142 snapped behind and interlocked with the interlocking portions 132 of the side wall 114.

Figure 35:
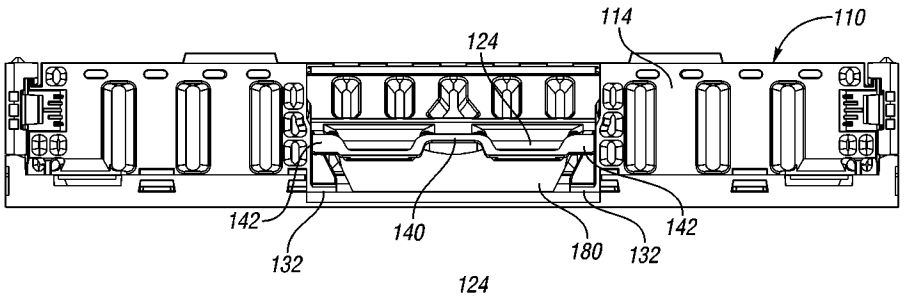
FIG. 35 shows the side view of FIG. 34 with the door partially open.

As shown in FIG. 35, the door 124 has been partially opened, after releasing the tabs 142 from the interlocking portions 132, such as by lifting the handle 140. Other types of latches could be used instead of the tabs 142 and interlocking portions 132.

Figure 36:
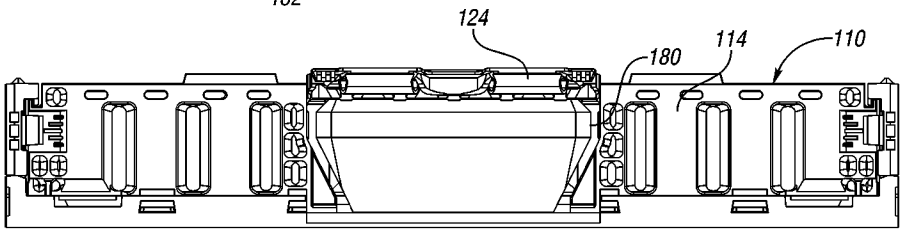
FIG. 36 shows the side view of FIG. 34 with the door in the open position.

As shown in FIG. 36, the door 124 is pivoted to the open position, such that the container 180 can be removed from the crate 110 through the side wall 114.

Figure 37:
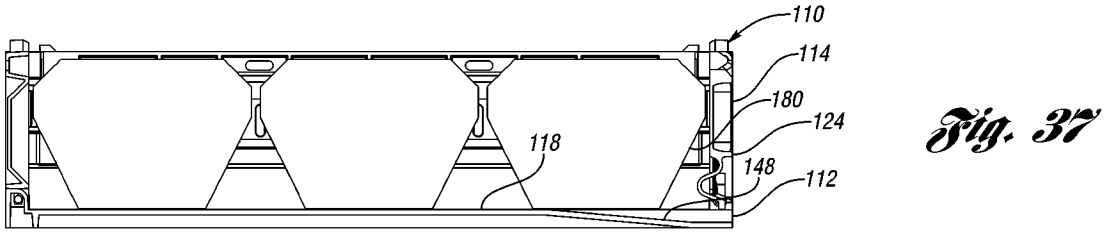
FIGS. 37-39 are section views taken through the side wall, which correspond to FIGS. 34-36, respectively.
Figure 38:
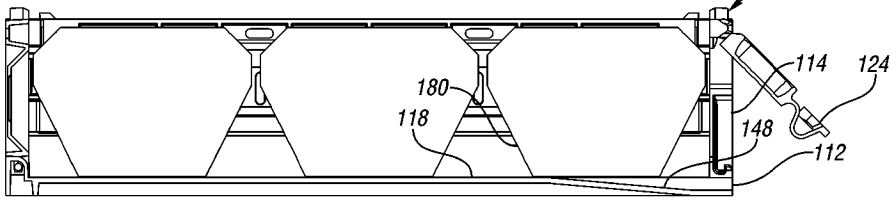
Figure 39:
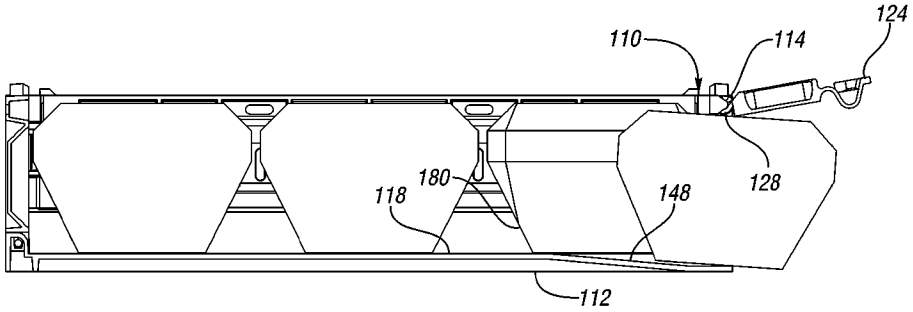

FIGS. 37-39 are section views taken through the side wall 114, which correspond to FIGS. 34-36, respectively. Referring to FIG. 37, the base 112 includes the upper panel 118 upon which the containers 180 are supported. The upper panel 118 includes a sloped portion 148, which slopes downward within the base 112, leading to the door 124. As shown in FIGS. 39 and 39, the sloped portion 148 provides sufficient clearance for the container 180 to be removed from the crate 110 below the rail 128.

Alternatively, the base 112 could be provided with a panel 118 that is positioned lower, with a drag rail protruding downward therefrom for reinforcement, where the drag rail would be received within the walls (nested) of a similar crate on which it was stacked, such that the stacking height would not be increased.

Figure 40:
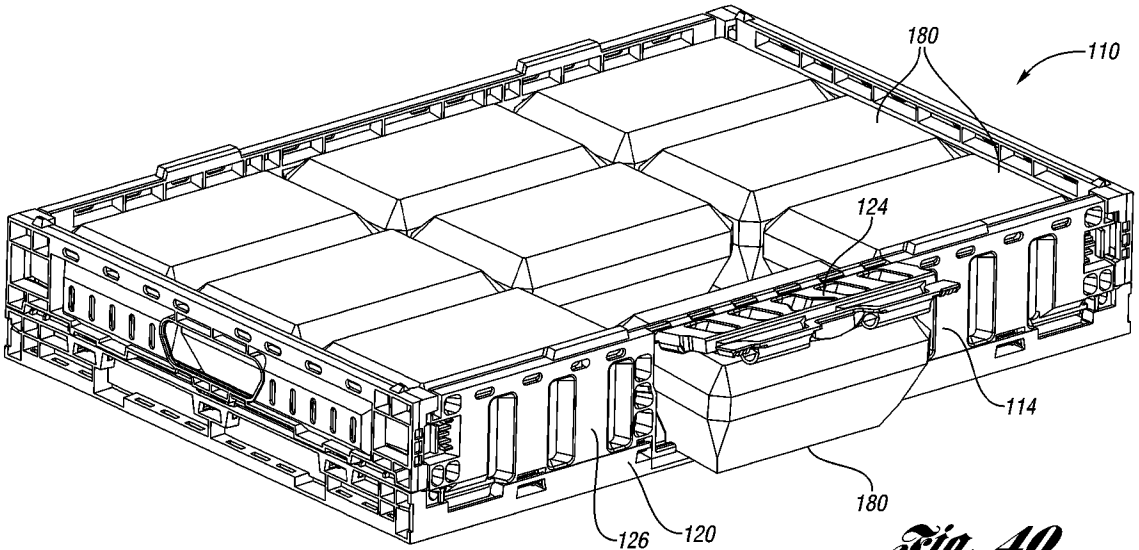
FIG. 40 is a perspective view of the crate and containers of FIG. 32 with one of the containers being removed through the opening in the side wall, as in FIGS. 36 and 39.
Figure 41:
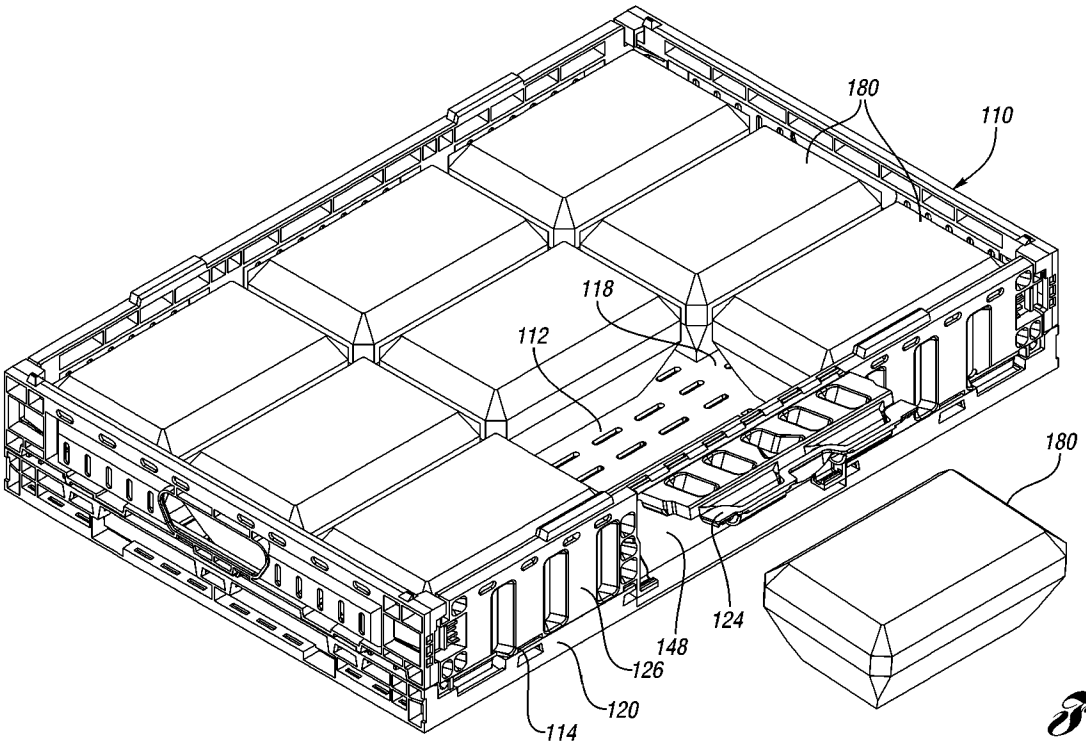
FIG. 41 shows the crate and containers of FIG. 32 with one of the containers removed.
Figure 42:
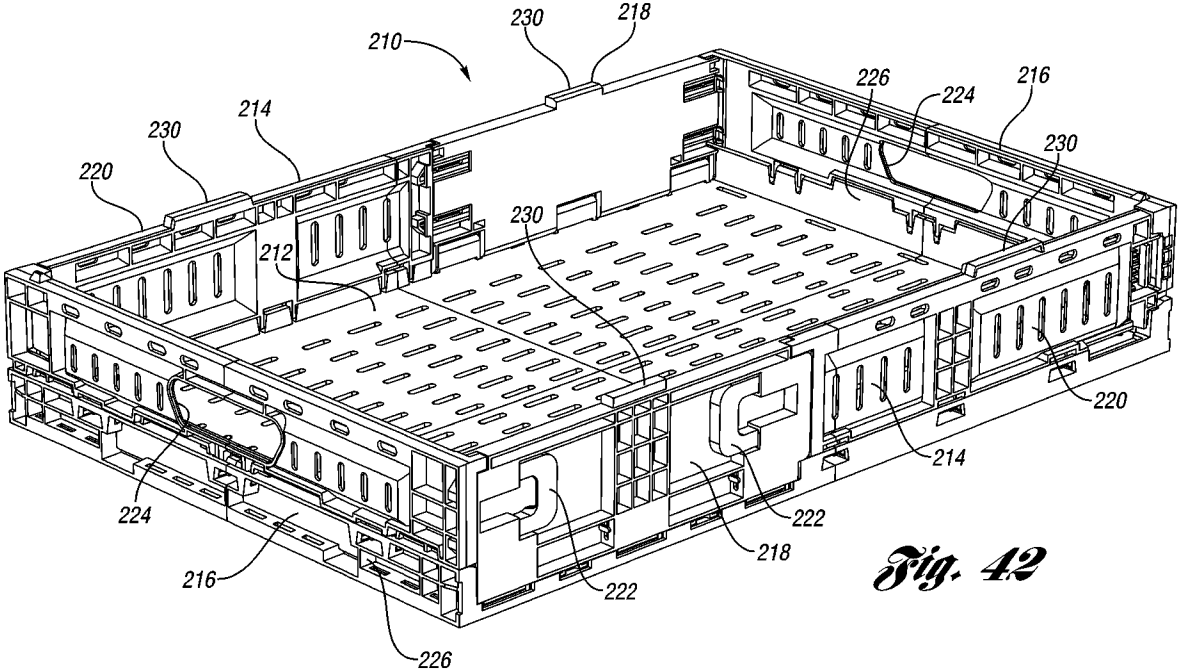
FIG. 42 is a perspective view of a crate according to a third embodiment.

FIG. 40 is a perspective view of the crate 110 with one of the containers 180 being removed through the opening in the side wall 114, below the open door 124. After the first container 180 is removed, as shown in FIG. 41, the remainder of the containers 180 can also be removed through the opening in the side wall 114. As can be seen in FIG. 41, the side upstanding portion 120 includes an opening therethrough aligned with the sloped portion 148 of the base 112 and aligned with the opening in the side wall 114 between the outer wall portions 126.

In use, a plurality of the crates 110 loaded with containers 180 can be stacked on one another. While stacked, the door 124 of any of the crates 110 can be opened and containers 180 can be removed from the crate 110 without having to remove the crates 110 stacked thereon. Empty crates 110 would then be collapsed as shown in FIG. 31 to reduce volume as they are returned to the warehouse or distribution point to be reused with additional containers 180.

A collapsible crate 210 according to a third embodiment of the present invention is shown in FIGS. 42-52. The crate 210 includes a base 212, with side walls 214 and end walls 216 hingeably connected thereto. Each of the side walls 214 includes a first portion 218 (or door 218) and a second portion 220 selectively connected together. Latches 222 mounted on the first portion 218 selectively connect the first portion 218 to the second portion 220 and to the end wall 216.

Each end wall 216 may include a handle opening 224 formed therein. Each end wall 216 is hingeably connected to an upstanding end portion 226, which may be integrally molded with the base 212.

Figure 43:
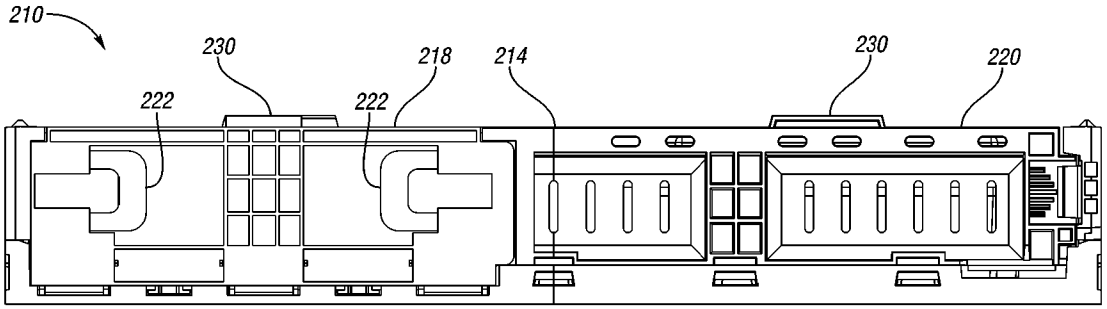
FIG. 43 is a side view of the crate of FIG. 42.

The first portion 218 and second portion 220 may each be approximately half the length of the side wall 214, or as shown in FIG. 43, the first portion 218 may be slightly shorter. The first portion 218 and the second portion 220 may each include a locating tab 230 projecting upwardly therefrom for interlocking with the base 212 of an identical crate 210 stacked thereon.

Figure 44:
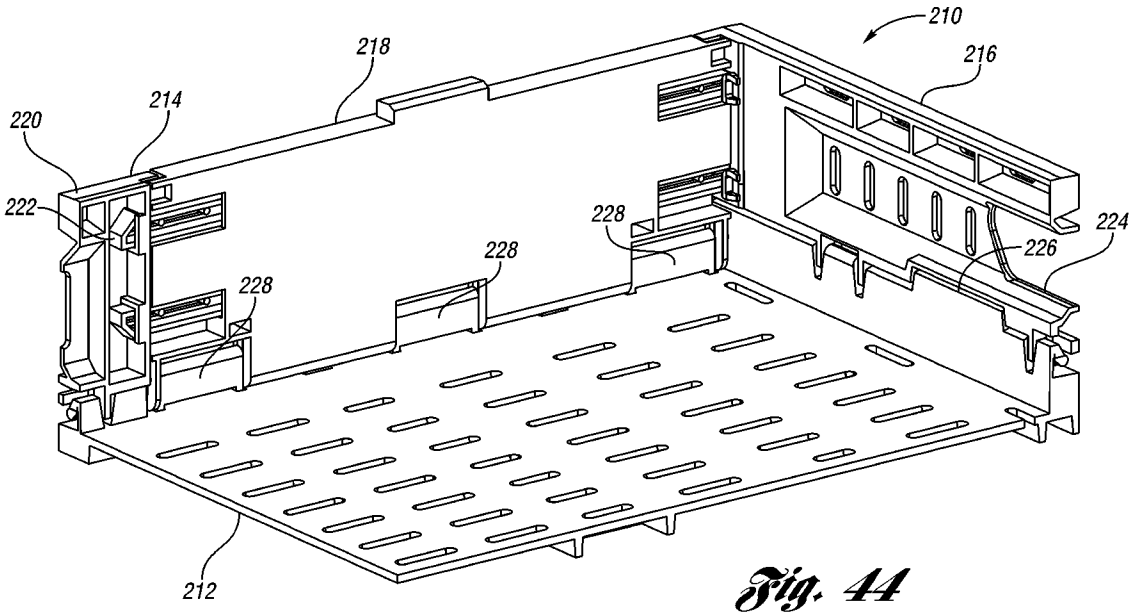
FIG. 44 is an interior perspective view of one of the corners of the crate of FIG. 42.

FIG. 44 is an interior perspective view of one of the corners of the crate 210. The first portion 218 is pivotably connected to the base 212 via hinge connectors 228. Each hinge connector 228 is pivotably connected at a lower end to the base 212 and pivotably and slidably connected at an upper end to the first portion 218. The latches 222 are shown connecting the first portion 218 to the second portion 220.

Figure 45:
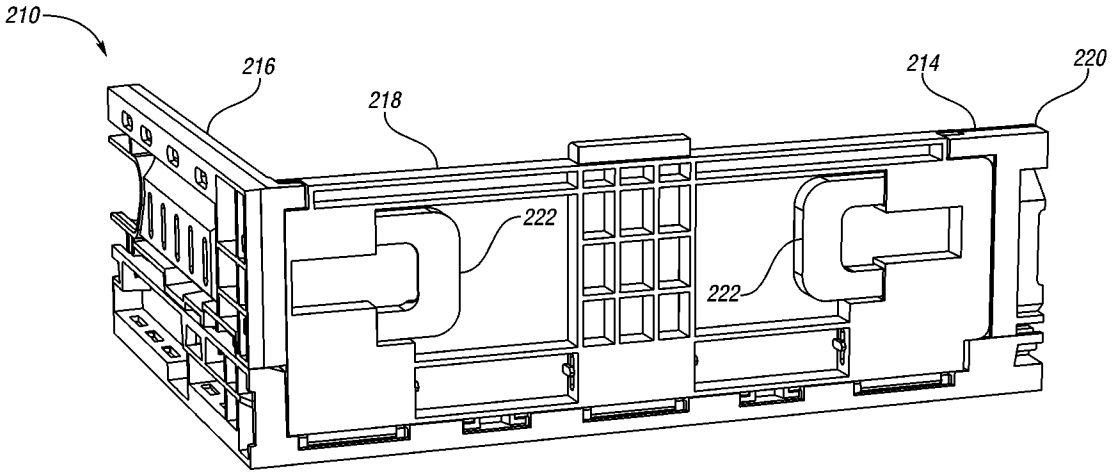
FIG. 45 is an exterior view of the corner of FIG. 44 with the latches in the latched position.

FIG. 45 is an exterior view of the corner of FIG. 44 with the latches 222 in the latched position. Large, simple, sliding latches 222 that each connect at two vertically spaced points are shown, but other types of latches could also be used.

Figure 46:
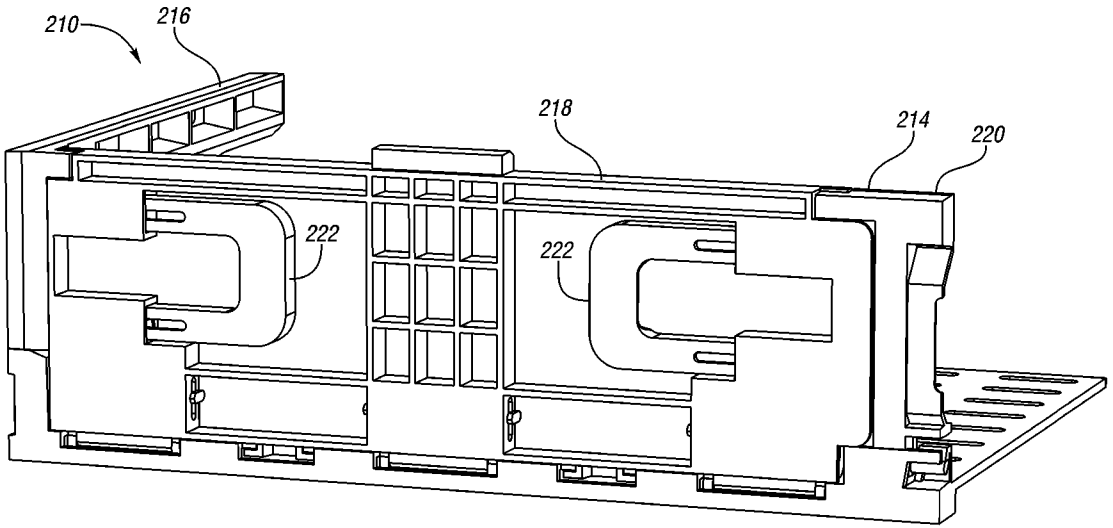
FIG. 46 shows the corner of FIG. 44 with the latches moved to the unlatched position.
Figure 47:
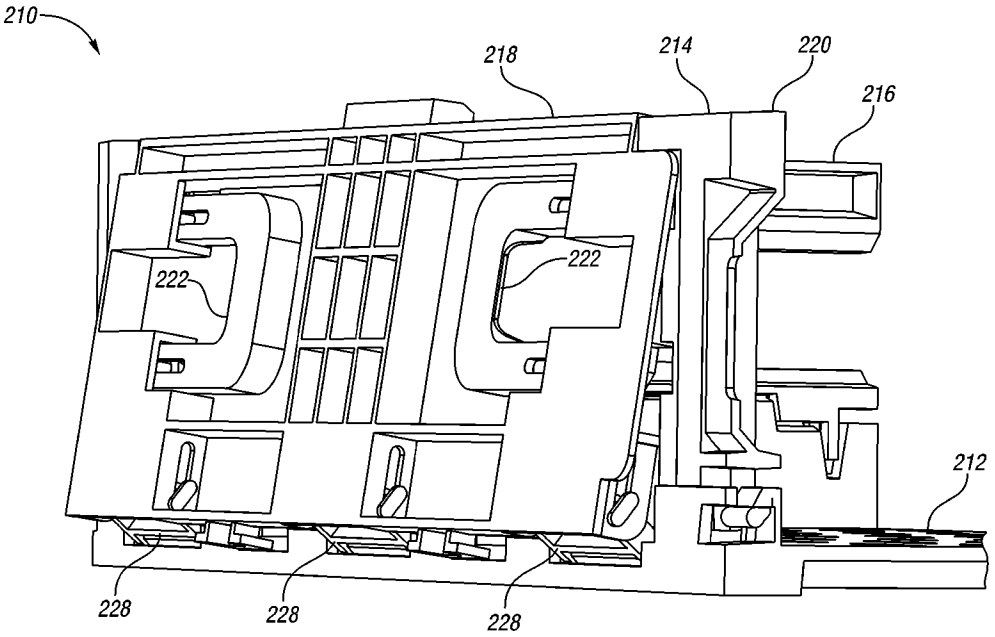
FIG. 47 shows the corner of FIG. 44 with the latches released and the bottom of the door pivoted outward from the base.

FIG. 46 shows the corner of FIG. 44 with the latches moved to the unlatched position. As shown in FIG. 47, when the latches 222 are released, the bottom of the first portion 218 can be pivoted out from the base 212 without significantly moving the upper edge of the first portion 218 upward. As a result, the bottom of the first portion 218 can be pivoted outward even when there is an identical crate stacked on the crate 210 to release the tab 230 from below the base 212 of the crate 210 stacked thereon. To move to the position shown in FIG. 47, the hinge connectors 228 pivot and slide relative to the lower end of the first portion 218 and simply pivot relative to the base 212.

Figure 48:
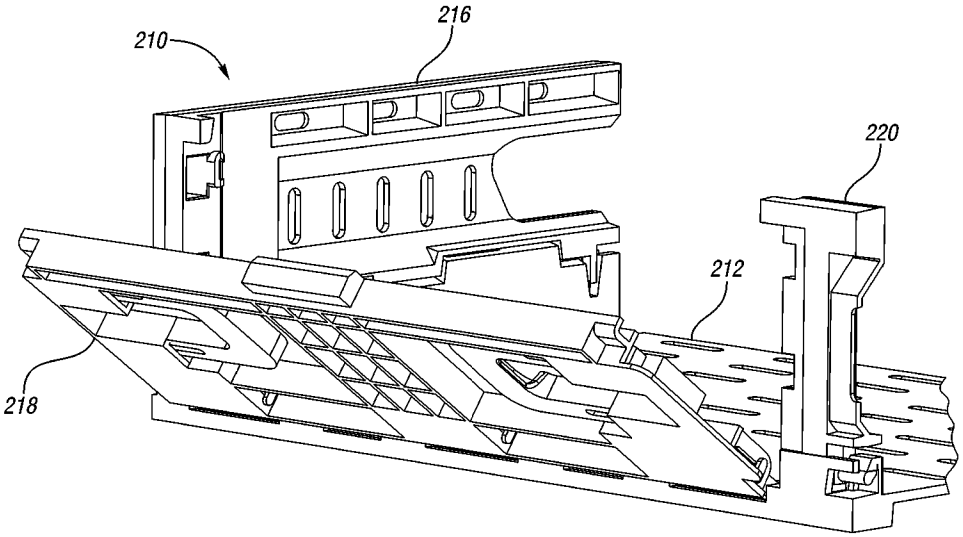
FIG. 48 shows the corner of FIG. 44 with the upper portion of the door pivoted partially away from the opening.
Figure 49:
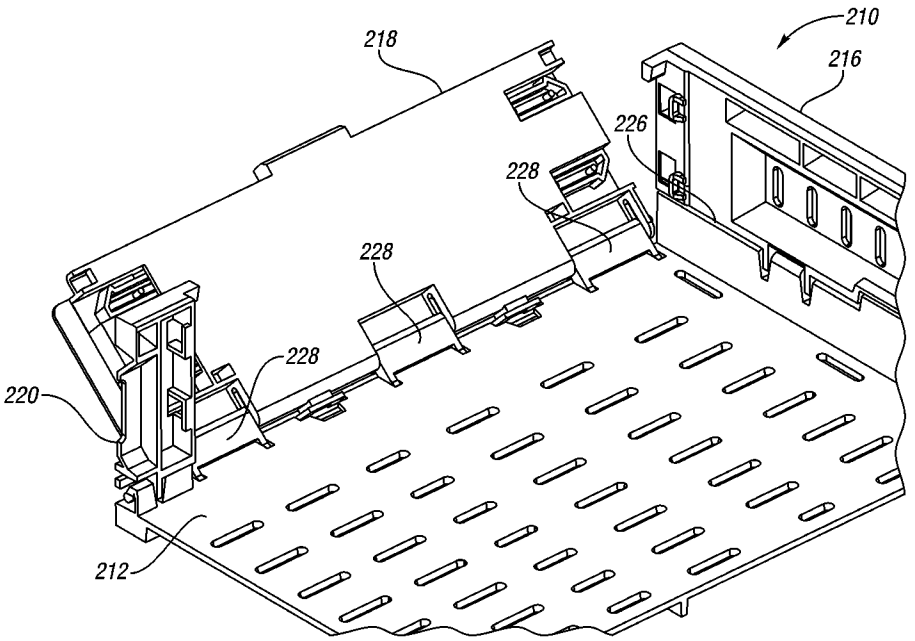
FIG. 49 is an interior view of the first portion being opened.
Figure 50:
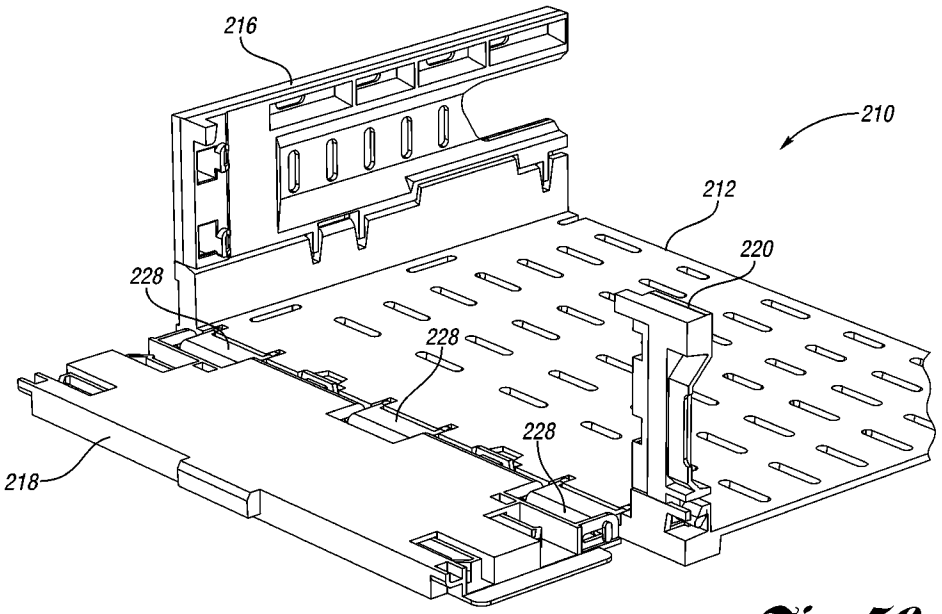
FIG. 50 shows the first portion opened outward.
Figure 51:
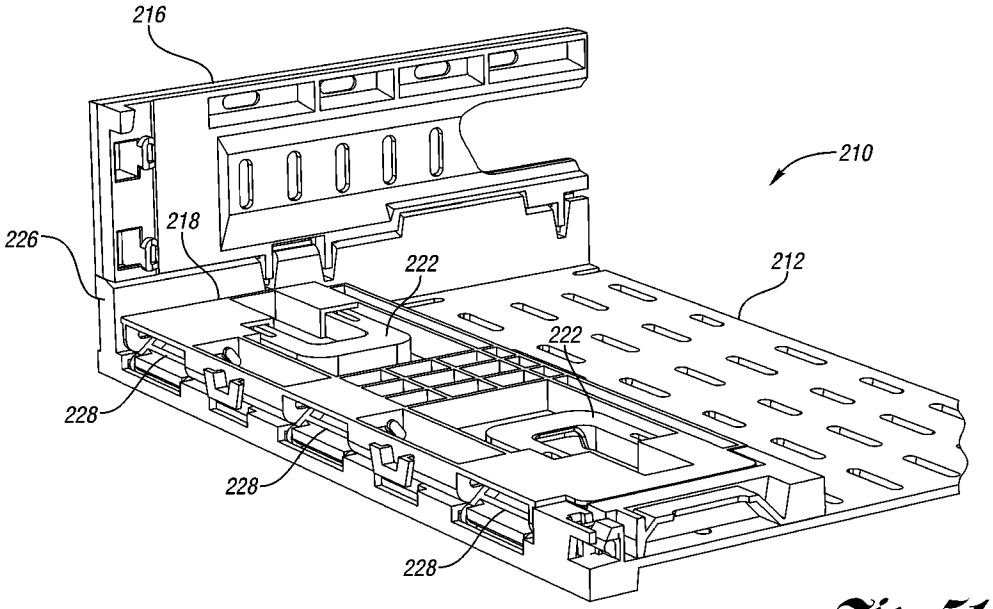
FIG. 51 shows the first portion collapsed inward.

Alternatively, as shown in FIG. 48, the upper end of the first portion 218 of the side wall 214 can be directly moved outward (if no other crate is stacked on the crate 210). FIG. 49 is an interior view of the first portion 218 being opened. As shown in FIG. 50, the first portion 218 of the side wall 214 can also be pivoted outward to where it is flat on the floor. As shown in FIG. 51, the hinge connectors 228 also make it possible for the side walls 214 to fold inward flat onto the base 212.

Figure 52:
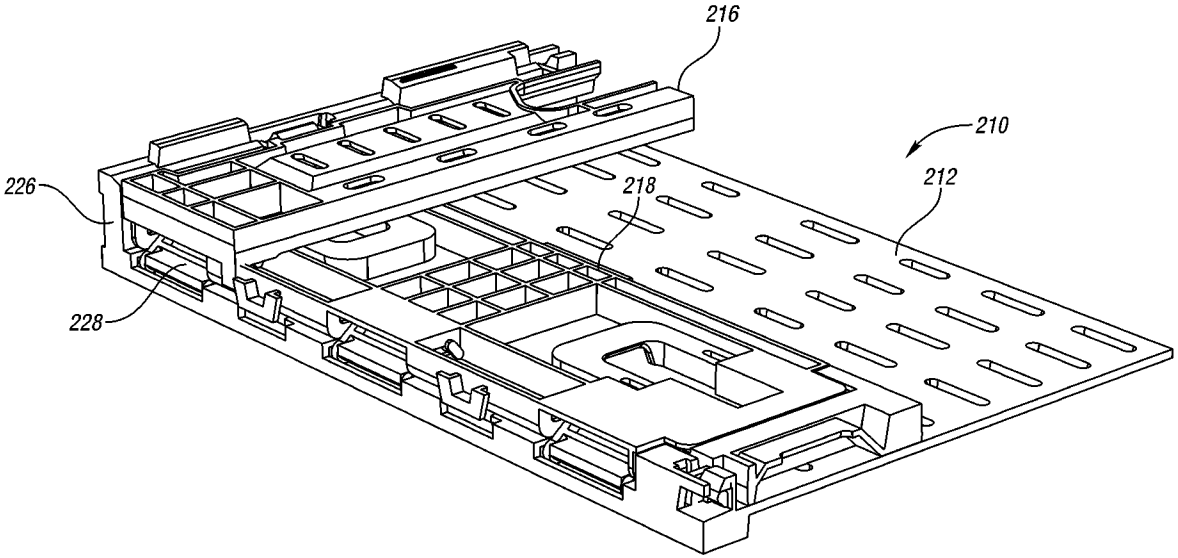
FIG. 52 shows the side walls and end walls collapsed onto the base.

In FIG. 52 the end walls 216 can then be collapsed onto the side walls 214 when the crate 210 is empty. This reduces the amount of spaced required to ship and store empty crates 210. Although the crate 210 is described and shown as having a door 224 formed in each of the side walls 214, doors 218 could also be provided in just one of the side walls 214 and/or in the end walls 216.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A collapsible container comprising:

a base;

a plurality of walls including a first wall and a pair of end walls perpendicular to the first wall, the plurality of walls pivotable between an upright position and a collapsed position on the base, the first wall including a rail portion below which is partially defined an opening; and a first door selectively covering the opening through the first wall, the first door slidably mounted to the rail portion and slidable in a first direction from a closed position covering the opening toward an open, retracted position away from the opening, wherein the first door is closer to one of the end walls when in the open position than when in the closed position, wherein the first door moves along an arc from the closed position to the open position, wherein the arc is parallel to the plane of the first wall.

2. The collapsible container of claim 1 wherein the base includes a downwardly sloped portion below the rail portion to facilitate removal of objects from the container through the opening.

3. The collapsible container of claim 1 further including a second door slidably mounted to the rail portion.

4. The collapsible container of claim 3 further including a latch selectively connecting the first door to the second door.

5. A collapsible container comprising:

a base;

a plurality of walls including a first wall and a pair of end walls perpendicular to the first wall, the plurality of walls pivotable between an upright position and a collapsed position on the base, wherein the first wall includes a rail portion below which an opening is partially defined; and a first door selectively covering the opening through the first wall, the first door slidably mounted to the rail portion and slidable in a first direction from a closed position covering the opening toward an open, retracted position away from the opening, wherein the first door is closer to one of the end walls when in the open position than when in the closed position, wherein the first door includes a plurality of alternating upper teeth projecting inward over the rail portion thereby slidably interlocking with the rail portion.

6. A collapsible container comprising:

a base;

a plurality of walls including a first wall and a pair of end walls perpendicular to the first wall, the plurality of walls pivotable between an upright position and a collapsed position on the base, wherein the first wall includes a rail portion below which an opening is partially defined;

a first door selectively covering the opening through the first wall, the first door slidably mounted to the rail portion and slidable in a first direction from a closed position covering the opening toward an open, retracted position away from the opening, wherein the first door is closer to one of the end walls when in the open position than when in the closed position; and lower teeth projecting downward along a lower edge of the first door and spaced above the base.

7. The collapsible container of claim 1 wherein the first wall includes an outer wall portion connected to the rail portion, the first door adjacent the outer wall portion when the first door is in the retracted position.

8. The collapsible container of claim 7 wherein the first wall includes a cover secured to the outer wall portion, the first door received between the outer wall portion and the cover when the first door is in the retracted position.

9. A container comprising:

a base;

a plurality of walls extending upward from the base including a first wall, the first wall including an outer wall portion adjacent an opening through the first wall, the first wall including a rail portion defining the opening therebelow;

a first door slidably mounted to the rail portion, the first door is slidable between an open, retracted position away from the opening and a closed position covering the opening, wherein the first door is parallel to and adjacent the outer wall portion in the retracted position; and a second door slidably mounted to the rail portion, wherein the first door and the second door each include a plurality of alternating upper teeth projecting inward above the rail portion thereby slidably interlocking with the rail portion.

10. The container of claim 9 wherein the base includes a downwardly sloped portion below the rail portion to facilitate removal of objects from the container through the opening.

11. The container of claim 9 wherein the first door moves along an arc from the closed position to the open position, wherein the arc is generally parallel to the first wall.

12. The container of claim 9 further including lower teeth projecting downwardly from a lower edge of the first door and spaced above the base.

13. The container of claim 9 wherein the outer wall portion is connected to the rail portion, a cover secured to the outer wall portion, the first door received between the outer wall portion and the cover when the first door is in the retracted position.

14. A collapsible container comprising:

a base;

a plurality of walls extending upward from a periphery of the base including a first wall, the plurality of walls pivotable between an upright position and a collapsed position on the base, the first wall including an opening therethrough, the base including a downwardly sloped portion proximate the opening through the first wall to facilitate removal of objects from the container through the opening; and a first door selectively covering the opening through the first wall.

15. The collapsible container of claim 14 wherein the first wall includes a cover secured to an outer wall portion adjacent the opening, the first door received between the outer wall portion and the cover when the first door is in an open, retracted position.

16. The collapsible container of claim 14 wherein the first door is parallel to the first wall in a closed position over the opening, the first door parallel to the first wall in the retracted position.

17. The collapsible container of claim 14 wherein the first wall includes a rail portion below which the opening is partially defined, the first door pivotably mounted to the rail portion.

18. The collapsible container of claim 17 wherein an upper edge of the first door is pivotably mounted to the rail portion.

* * * * *